US008465444B1

(12) United States Patent
Kopacki et al.

(10) Patent No.: US 8,465,444 B1
(45) Date of Patent: Jun. 18, 2013

(54) LAMINITIS TREATMENT SYSTEM AND METHOD

(75) Inventors: Matthew H Kopacki, Ringwood, NJ (US); Michael J Torsiello, Pleasant Mount, PA (US)

(73) Assignee: Medergo Associates, LLC, Ringwood, NJ (US)

( * ) Notice: Subject to any disclaimer, the term of this patent is extended or adjusted under 35 U.S.C. 154(b) by 303 days.

(21) Appl. No.: 13/083,779

(22) Filed: Apr. 11, 2011

Related U.S. Application Data

(60) Provisional application No. 61/342,192, filed on Apr. 9, 2010.

(51) Int. Cl.
*A61H 7/00* (2006.01)
*A61H 19/00* (2006.01)

(52) U.S. Cl.
USPC ..... 601/152

(58) Field of Classification Search
USPC ..... 601/148–152; 602/13, 14, 23; 119/856
See application file for complete search history.

(56) References Cited

U.S. PATENT DOCUMENTS

| | | | | | |
|---|---|---|---|---|---|
| 3,378,004 | A * | 4/1968 | Chase et al. | ..... | 601/166 |
| 3,871,381 | A * | 3/1975 | Roslonski | ..... | 607/104 |
| 4,794,991 | A * | 1/1989 | Honderich | ..... | 168/26 |
| 4,981,010 | A * | 1/1991 | Orza et al. | ..... | 54/82 |
| 5,167,227 | A | 12/1992 | Meserlian | | |
| 5,174,382 | A * | 12/1992 | Wright | ..... | 168/28 |
| 5,968,073 | A | 10/1999 | Jacobs | | |
| 6,558,338 | B1 | 5/2003 | Wasserman | | |
| 2004/0097860 | A1 * | 5/2004 | Tauber | ..... | 602/75 |
| 2007/0114045 | A1 * | 5/2007 | Morris et al. | ..... | 168/14 |
| 2008/0311222 | A1 * | 12/2008 | Pound et al. | ..... | 424/637 |

* cited by examiner

*Primary Examiner* — Kristen Matter
(74) *Attorney, Agent, or Firm* — W. Patrick Quast, Esq.

(57) ABSTRACT

A system and methodology for treatment of circulation related conditions in hooved animals such as laminitis in horses. The methodology employs a garment wrap that is releasably secured to the animal's leg. The wrap includes several inflatable chambers, one of which, the most distal one, engages the frog and bulbar sections of the horses hoof. The methodology calls for the pressuring of the inflatable chambers in accordance with a sequence that prevents backflow from a more proximal point on the animal's leg to a more distal point on the leg. A boot arrangement including an inner sole pad are also utilized both during the therapy procedure and afterwards. The inner sole pad can provide related medications and can be used in an iontophoresis procedure.

19 Claims, 21 Drawing Sheets

LAMINITIS TREATMENT SYSTEM AND METHOD

CROSS-REFERENCE TO RELATED APPLICATIONS

This application claims the benefit of U.S. Provisional Application Ser. No. 61/342,192, filed Apr. 9, 2010, the entirety of which application is herein incorporated by reference.

FIELD OF THE INVENTION

The present invention relates generally to a circulatory treatment system and method useful particularly in reducing the symptomatology and/or rehabilitation of a condition known as laminitis and other debilitating conditions in the leg of an equine or similarly structured animal.

BACKGROUND

One of the inventors in this application is a physician, who is a plastic and reconstructive surgeon and a wound healing specialist practicing for more that twenty-five years. In his practice he has encountered, studied, and treated all wounds on every location of the human body. His experience confirms that, whatever the mechanism of action, surgical, traumatic, neo-plastic, arterial disease, venous stasis, lymphatic, pressure, infectious, caustic, thermal, hypothermal, infarction, or (strangulation), every and all wounds are the direct result of the disruption of the circulatory system.

Further, this one inventor has been a horse owner and rider for all of his adult life. He has first hand knowledge of the condition of laminitis in horses. Over a period of fifteen years, he has made numerous attempts through consultations with veterinarians, attendance at conferences on the subject and a reading of the literature in an effort to find the underlying cause of the condition, the mechanism of injury, and perhaps a cure for the condition which baffles the equine world and the second largest cause of euthanasia in horses.

In his own experience he has personally cared for his own horse and has shepherded her through at least six episodes of this condition which almost took her life. This has led him to conclude that laminitis, with its multiplicity of purported causes, must be treated aggressively, early, and with a multiplicity of modalities.

As noted above, this one inventor has been involved in plastic and reconstructive surgery. He is a wound care specialist involved in the healing of wounds of all types. He has treated patients with vascular extremity wounds and having made the comparison with the human model, he has applied it to the equine model. This inventor concludes that it is clear, as now documented in the literature, that laminitis is a vascular disease occurring at the arteriovenous junction within the confines of a closed space—the hoof.

Laminitis is defined as the debilitating persistent and chronic condition of horses' hooves, which occurs when a critical mass of the interwoven complexes of connective tissue and blood vessels which hold the distal phalanx, P3, (coffin bone), to the inner surface of the keratinized hoof, fail to function. This is the result of a number of systemic and physiological causes. The attachments separate, become "devascularized" and detach from the hoof's inner wall. The strong pull of the deep flexor tendon on the coffin bone and the combination of the weakened attachments, causes the bone to rotate downward creating severe pain, edema, venous congestion and lymphedema and significant debilitation. When left unchecked, this condition results in "founder" an old term for exposure of the coffin bone, through the sole of the hoof. This most commonly renders the animal unable to survive and usually results in euthanasia.

In his human practice the one inventor has used a variety of compression devices to alleviate the problems of venous stasis, peripheral vascular disease and lymphedema with great success. These treatments of the human condition are well described in the literature and proven by evidence-based studies. It has been shown that venous stasis and increased pressure in the extremity, as a result of incompetent valves and shunting of the blood to the level of the skin, causes pressure ulcers. Because the skin is expandable living tissue, the increased pressure impinges on the sub-dermal plexus of the skin and causes a breakdown resulting in an ulcer.

The incompetent valves and venous congestion cause dilation, pressure, and cause proteinaceous material to leak into the extra cellular and sub-cutaneous tissue, (a so-called "third space") resulting in more edema obstruction of the lymphatics. This causes extremity swelling and tightening of the skin to maximum expansibility, thus impeding the arterial flow to that extremity. Peripheral vascular disease i.e. arterial inflow obstructions, causes severe pain, anoxia, swelling and compromise to the overall vascular flow to the extremity. The anoxia to the tissue causes lactic acidosis build up, cramping, electrolyte imbalances, cellular destruction and severe pain.

The external compression devices currently on the market, to some degree, decrease the congestion, drive the third space proteinaceous material and lymphatic drainage back into the venous system, relieving the skin of pressure, and improving the condition of wounds. All of these external devices mimic the return flow of the venous system as well as decompress and mobilize the third space edema. The decompression of the lymphatic system thus reduces the overall pressure on the arterial system. This is all achieved by improving the gradient between the arterials and the venules, thus improving the overall extremity flow, oxygenation and wound healing. Oxygenation and arterial flow is necessary for all wounds to heal. Venous stasis in tissue can destroy an extremity. A long recognized modality of venous decompression used for centuries is the application of leeches, which allow for continued arterial flow increasing oxygenation.

If we extrapolate the human model to the equine model the exact same venous and arterial congestion occurs with the disruption of the arteriovenous system in the hoof. This inhibits osmotic transmission and once the continuum is broken and the hemodynamic equilibrium is affected, the attachments to the hoof wall tear. With the tearing there is a high probability of hematoma. With a clot formation further increasing the pressure, the arterial side becomes compressed also failing to deliver oxygen. Edema results, causing pain thus setting up the cycle of pain, edema, compression and more pain.

It is the result of the changes in the hydrostatic pressures that causes the tearing of the lamellae. This occurs within the closed space of the hoof which needs circulation for its survival. The cycle of pain, inflammation, more pain and more tearing becomes unbroken.

This is accompanied by a secondary phenomenon that is the strong pull of the deep flexor tendon. This tendon, having the strongest dynamic attachments to the posterior of the coffin bone, begins its strong pull in the direction of flexion. The counterbalance of the coffin bone is its strong attachment to the hoof wall by the lamellae. With the lamellae failing to adhere to the hoof wall, the flexor begins to rotate the coffin bone downward.

The construction of the extremity in a "digitaped" (or ungulate, i.e., a hooved animal, such as a horse) is such that the skeletal system suspends the animal in a perfectly balanced situation within the skin and the hoof. A disruption of this perfect balance, as well as the pain and the edema associated with the imbalance, allows the flexor to work unchecked, pulling more lamellae free creating more swelling, more bleeding and more pain. The increased edema within the confines of a closed space transmits more pain along the paratenon of the flexor tendon creating a secondary tendonitis.

The laminitis literature implicates a multitude of factors causing this condition: overfeeding, carbohydrate overload, stress, genetics, insulin resistance, injury, and Cushing's syndrome. The cycle as described is pain, inflammation, venous stasis, more inflammation and more pain. The secondary effects of the tendonitis render the animal so incapacitated as to be "paralyzed". The cycle must be broken either by stopping the edema (stasis), decongesting the arterial flow, or controlling the pain.

Because of the multiplicity of factors implicated in the cause of the condition, the treatment becomes symptomatic on all levels in an effort to salvage the animal.

After having made the association from the human model to the equine model and having had an animal with this chronic recurring problem, the episodes were noted to have an increased intensity and duration with each exacerbation. The one inventor has treated all the episodes which this horse has had with the usual symptomatic treatments: remove the grass, reduce the carbohydrate loads, rocker shoes, pads, analgesics, anti-inflammatories, etc.

During the more recent occasions, in association with the usual symptomatic treatment, the present inventors have added to this the modalities described in this application. The most significant of these is associated with the retrograde massage of the extremities. This type massage starts at the pastern and sequentially moves upward to the cannon bone, metacarpals (knee), ulna-radius to the elbow. This is done in a manner like squeezing a tube of toothpaste from bottom to top. This procedure done on a consistently routine basis reduced the edema and shortened the acute phase interval to the point where the horse was up walking within three to five days. She went on to heal through the re-establishment of the circulation so that the overall long term damage of the condition was minimized. The inventor has recognized that there is less duration, severity and permanent damage when the duration between the appearance of the symptoms of the condition and the consistent application of the retrograde massage methodology is shortened. This is a direct correlation for the one inventor's treatment with the human model.

There is a multitude of compression devices on the market today prescribed for human use. There are, to our knowledge, none on the market for equines. Having used a number of these devices, the most efficacious one to date for humans is the PERISTALTIC PNEUMATIC COMPRESSION DEVICE or similarly applicable device available through the NormaTec Company of Newton Center, Mass. (hereinafter the "NormaTec" and/or PCD device). It has been used on humans with excellent results. We intend to explain, modify and improve on this device to adapt it for use in the equine model for not only improving the condition of laminitis but as a rehabilitative device to improve the circulation in the extremities of horses suffering from the myriad of conditions inflicted upon them by man i.e. navicular disease, bowed tendons, tendonitis, pressure sores, wounds of all types, therapy for fractures, surgeries, post sports injuries, mobilization of exercise-induced, lactic acid build-up, edema of all sorts associated with racing, stocking up, pulmonary congestion, lymphedema, and performance and show injuries in the equine.

The NormaTec device prescribed for humans, when adapted to the equine, must be modified significantly.

The areas where the changes are most apparent from the existing art are:

1. construction of the leg including hoof enveloping garment;
2. chambers equipped with D-rings on Velcro® brand fasteners or similar supplier;
3. apparatus lining with fleece or sheep's skin, removable and washable so as not to transfer body fluids associated with cross contamination, for,
   a. suppression of pressure on tendons,
   b. absorption of sweat and body fluids when over an open wound, and,
   c. prevention of blistering and pressure sores;
4. larger bore, delivery tubing to accommodate more volume more rapidly and to decompress more rapidly;
5. an interposed compression device for the initiation of a pressure wave much more rapidly;
6. a different sequence to the pressure wave to ensure no back flow;
7. a time sequence with shorter duration interval for a faster wave;
8. a rapid release methodology for emergency exit (tubing and D-rings); and, Construction The NormaTec device or similar supplier is basically a legging. It is a unitary circumferential device. The patient steps into or pulls the legging into or over a secondary garment—a cotton stocking extending from the lower extremity of the foot upward to the thigh. The legging usually consists of four to five pneumatic chambers depending on the size of the patient.

This apparatus needs to be modified to accommodate circumstances unique to the equine application. For example, a. The apparatus will necessitate being applied as a wrap rather than a contiguous pants-like legging (in humans it must be applied in the recumbent position which is not the case with the equine who stands from the moment of birth). Lifting the leg will not be an option for two reasons:
   1. The condition of laminitis will not accommodate the lifting of one front leg because of the associated pain i.e. the horse's stance is now a tripod. The literature surrounding laminitis regularly refers to the horse's feet being "nailed to the ground".
   2. In the event of an emergency, the boot will need to be removed rapidly, i.e. if the animal goes down or needs other emergency treatment, he will entangle himself and needs to be disengaged rapidly and easily.
b. Since the horse must stand on its fingertips with a minimally compressible hoof, the design will obviously be modified for various safety and efficacious reasons.
c. Frictional forces on the tendon area from the movement of the garment during inflation/deflation phases can create blistering, soreness and pressure sores. The wrap member will need a fleece or sheep skin type removable lining for the comfort and therapeutic administration of the appropriate pressures and to minimize the contact and heat generated by frictional forces.
d. To secure the wrap member-like device with a quick-release capability, the attachments typically will have to include D-Ring, Velcro® brand fasteners so as to draw upon themselves when inflated, and to avoid opening during the inflation phase. The attachments alternate, left to right, from top to bottom. ⇄ e. The tubing will be of a larger bore:

1. To initiate the flow more quickly.
2. To assure that the deflation cycle is more rapid.

The NormaTec device as it exists, has a long inflation time, and a long deflation time (both upwards of three minutes). This is because existing NormaTec tubing, which transfers the air pressure, has very small caliber diameter openings—less than one quarter inch. This restricts the inward and outward flow of the air, prolonging the treatment.

Interposed Compressor or Air Retention Chamber

The devices which exist have no such interposed chamber between the initiation of air flow and the boot. Without this chamber, the flow is restricted and the time interval is longer. This fact coupled with the narrow tubing restricts the volume of the flow of air thus making the rapidity of the inflation and deflation prolonged.

The presence of an intermittent compressor (or holding tank air chamber) in association with the larger tubing will improve the volume of the flow of air on an instantaneous release into the boot and shortens the duration for a five chamber device to a total, in the range of between 15 to 20 sec per complete cycle, unlike the NormaTec device which takes up to 3 minutes to fill and/or complete a cycle. The more rapid the compression/decompression cycle, the more comfortable and tolerable the procedure is. The treatment becomes more efficacious with a more rapid interval. This decreases the edema more rapidly in the extremity thus increasing the blood flow.

The interposed compressor or air chamber will ensure 15 seconds or less as a maximum inflation time and a compression ($P_H$ hereinafter) or decompression ($P_L$ hereinafter) interval of less than 15 to 30 seconds. This, in conjunction with the larger tubing, will also allow for the more rapid inflow and outflow, shortening the overall duration of the treatment. This more rapid interval of compression and decompression is necessary in an animal of prey, which is genetically geared to "fright or flight", and will allow for a more rapid accommodation to the device. The animal will tolerate rapid touching and decompression but would not tolerate grabbing and holding.

The NormaTec PCD device or similar device requires either stopping the air flow or interrupting the connection tubing in an emergency situation for decompression and removal of the garment. Because of the narrow tubing, decompression is very slow. The larger the garment, the more volume and the more difficult to deflate rapidly. This coupled with the small diameter of the tubing will create a problem for a horse. A fully inflated cycling garment will not allow the joints to flex since the animal is in a standing position. If the horse were to collapse without the garment deflating quickly enough, a fracture, dislocation or other permanent injuries could easily occur. A quick release valve, with a wide port, will be used to assist in the rapid decompression and quick removal of the compression wrap member, when necessary.

It is our objective through the use of this device to reduce the number and duration of the protracted conditions of laminitis in horses, as well as the vascular and extremity conditions created by equestrian sports, and to alleviate the discomfort. This hopefully will minimize: the extremes of surgical intervention such as cutting the tendon; the use of podiatric devices; and, the all too many cases of euthanasia, by bringing these animals back to soundness again.

SUMMARY OF THE INVENTION

Accordingly, it is an object of the present invention to provide an apparatus and methodology for the treatment of circulatory problems in hooved animals, including most especially the laminitis condition in equines.

It is a further object of the invention to provide a method and means for facilitating the application of necessary medications to the animal during the treatment process.

Therefore in accordance with the invention, a method of treatment is provided for the treatment principally of circulation problems in hoofed animals such as a horse. The invention includes the provisioning of a wrap member, having a predetermined length and a plurality of inflatable chambers, including a most distal one and a most proximal one, positioned at respective intervals along the length of the wrap member. The most distal one of the plurality of inflatable chambers is adapted to engage a compressible portion of the leg of the animal exposed within the hoofed area. The wrap member further includes the means to releasably secure the wrap member to the leg of the animal;

The methodology further requires the provisioning of a controllable pressure source which is connected to each of the inflatable chambers. The methodology calls for manipulating the wrap member using the means for releasably securing the wrap member, to position and secure the wrap member about the leg of the horse. The most distal one of the chambers engages the compressible portion of the leg of the animal exposed within the hoofed area. The most proximal one of the chambers engages a higher portion of the leg of the animal in an area predetermined by the length of the wrap member;

Once activated, the controllable pressure source is adapted to provide a plurality of repetitive cycles. Each one of the repetitive cycles comprises a first predetermined number of successive time intervals. The controllable pressure source is further adapted to provide during each time interval during the repetitive cycles, either a predetermined pressure of a higher magnitude, $P_H$, or of a lower magnitude, $P_L$, to a respective one of the plurality of inflatable chambers in accordance with a predetermined wave pattern, wherein the predetermined wave pattern requires that during each time interval of the one of the repetitive cycles, at least two immediately adjacent inflatable chambers are at $P_H$ pressure and at least one of the inflatable chambers is at $P_L$ pressure. The at least two immediately adjacent inflatable chambers at $P_H$ pressure over the time of each the repetitive cycle, progress from the most distal inflatable chamber and the next most distal one to the most proximal one and the next most proximal one.

The method of treatment further calls for the controllable pressure source to provide at least one ramp-up cycle extending over a second number of successive time intervals prior to the beginning of the repetitive cycles. The ramp-up cycle comprises a varying combination of the inflatable chambers inflated at $P_H$ and $P_L$ in accordance with a predetermined sequence based on the predetermined wave pattern.

The method of treatment still further calls for the controllable pressure source to provide at least one fill cycle prior to providing the at least one ramp-up cycle. In this fill cycle each of the inflatable chambers is filled at a pressure less than $P_H$ and typically, $P_L$.

The method of treatment still further calls for the disposition of the most distal one of the plurality of inflatable chambers within a boot which is releasably secured to the hoof of the animal. The boot is adapted to assist in the engagement of the most distal one of the inflatable chambers with the compressible portion of the leg of the animal.

The method of treatment still further calls for the disposition of an inner sole pad between an upper surface of the most distal one and the compressible portion of the leg of the animal exposed within the hoofed area. The pad facilitates the interaction between the bladder and the exposed area.

The method of treatment identifies that the inner sole pad is adaptable to be impregnated with a variety of medications including vasodilatory and topical anesthesia medications; as well as adaptable to be a facilitator with an electronically charged medicament delivery system.

DESCRIPTION OF THE PREFERRED EMBODIMENT

Figure 1:
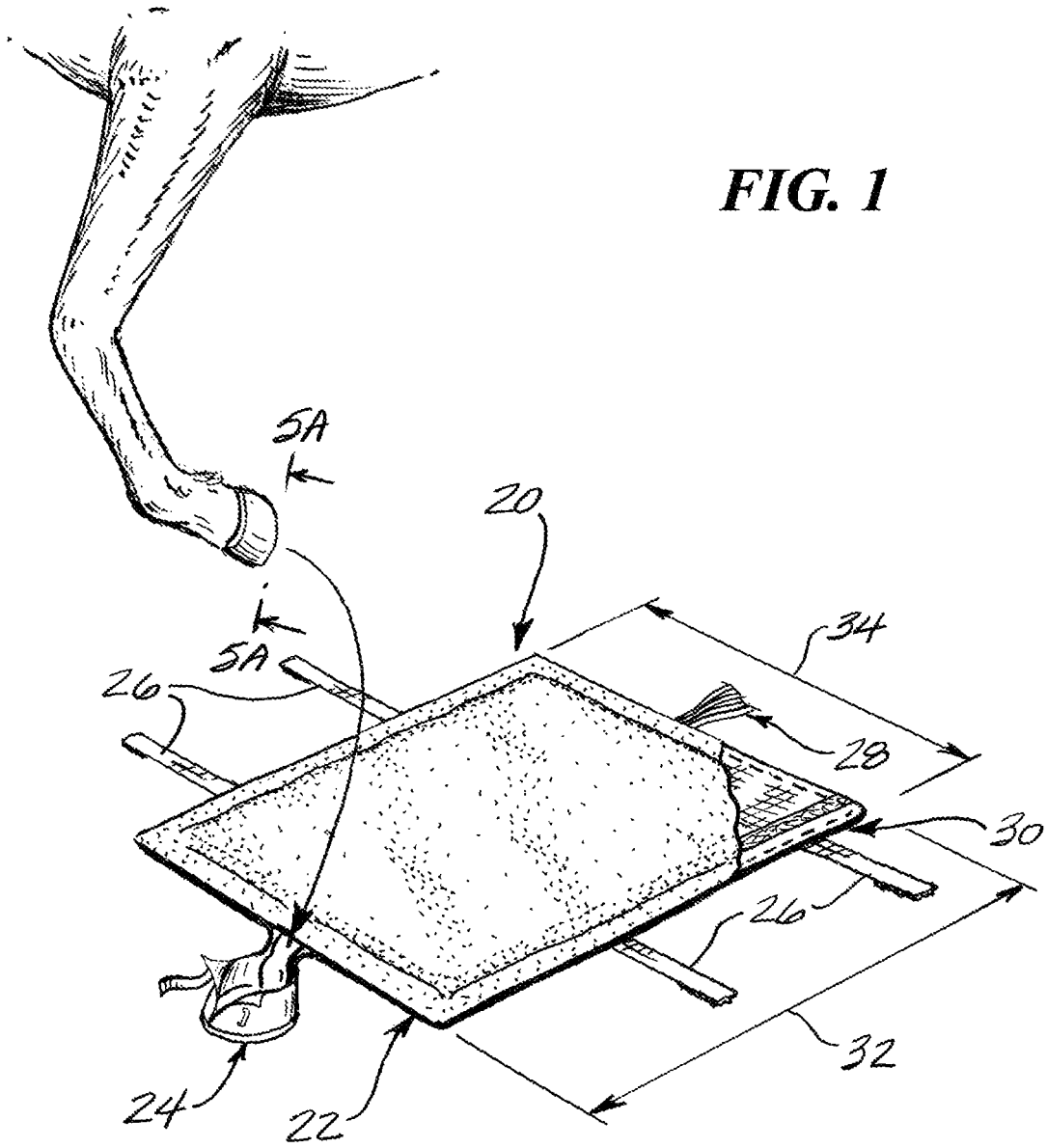
FIG. 1 is a perspective view of the compression wrap member portion of this invention prior to installing onto the leg of a horse.

A preferred embodiment of the treatment system and methodology of the present invention follows. Identical elements of the various portions of the invention will carry similar reference numerals throughout the drawing depictions.

In FIG. 1, a compression wrap member 20 portion of the system of the present invention is shown prior to installation on the animal. It includes a garment section 22 with a series of bladders, not readily seen in this figure, interposed between the layers of the garment section.

The wrap member 20 includes a hoof covering segment 24 as well as means 26 for releasably securing the wrap member 20 to the horse's limb. These typically comprise hook and loop, VELCRO or similar supplier straps available from "Seattle Fabrics", of Seattle, Wash. or similar supplier and include respective D-rings again not shown in this view, so as to draw upon themselves when inflated, thus maintaining the chamber demarcation and to avoid opening during the inflation phase. The hook and loop portions alternate in their placement, on the left or right of the closure, from the top to the bottom of the wrap member.

A plurality of compressed air supply tubes 28 are secured to the compression wrap member in a manner to be discussed hereinafter. The plurality of tubes further connects to a fluid supply, typically a tank of compressed air, not shown in this view. The tubing is of a larger bore sufficient to initiate the flow more quickly and to assure the deflation cycle occurs more rapidly. Typically, the tubing inner diameter would be on the order of 0.5 inches. The tubing can be reinforced in a known manner to ensure that it does not collapse during use. The tubing for the NormaTec device has relatively small diameter openings which prolong the treatment cycle. For one chamber the cycle time for the NormaTec device is greater than 30 seconds. For a five chamber device the overall cycle time for the NormaTec device from the distal to proximal chambers would be a minimum of 150 seconds. Our invention is designed to greatly reduce these times.

Means for securing the two layers of garment section 22 together are depicted at the perimeter 30. This can be implemented using the heat sealing characteristics of the materials comprising the two layers as noted below or by using radio frequency (RF) techniques. For a five bladder configuration, the typical length anticipated, 32, is on the order of 30 to 35 inches or tailored (custom) for a specific animal. The width 34, it is anticipated, would be on the order of 28 inches.

Although shown as having a rectangular configuration, the wrap member may be configured as tapered from a larger width at its proximal end to a smaller width at the hoof or distal end.

Figure 2:
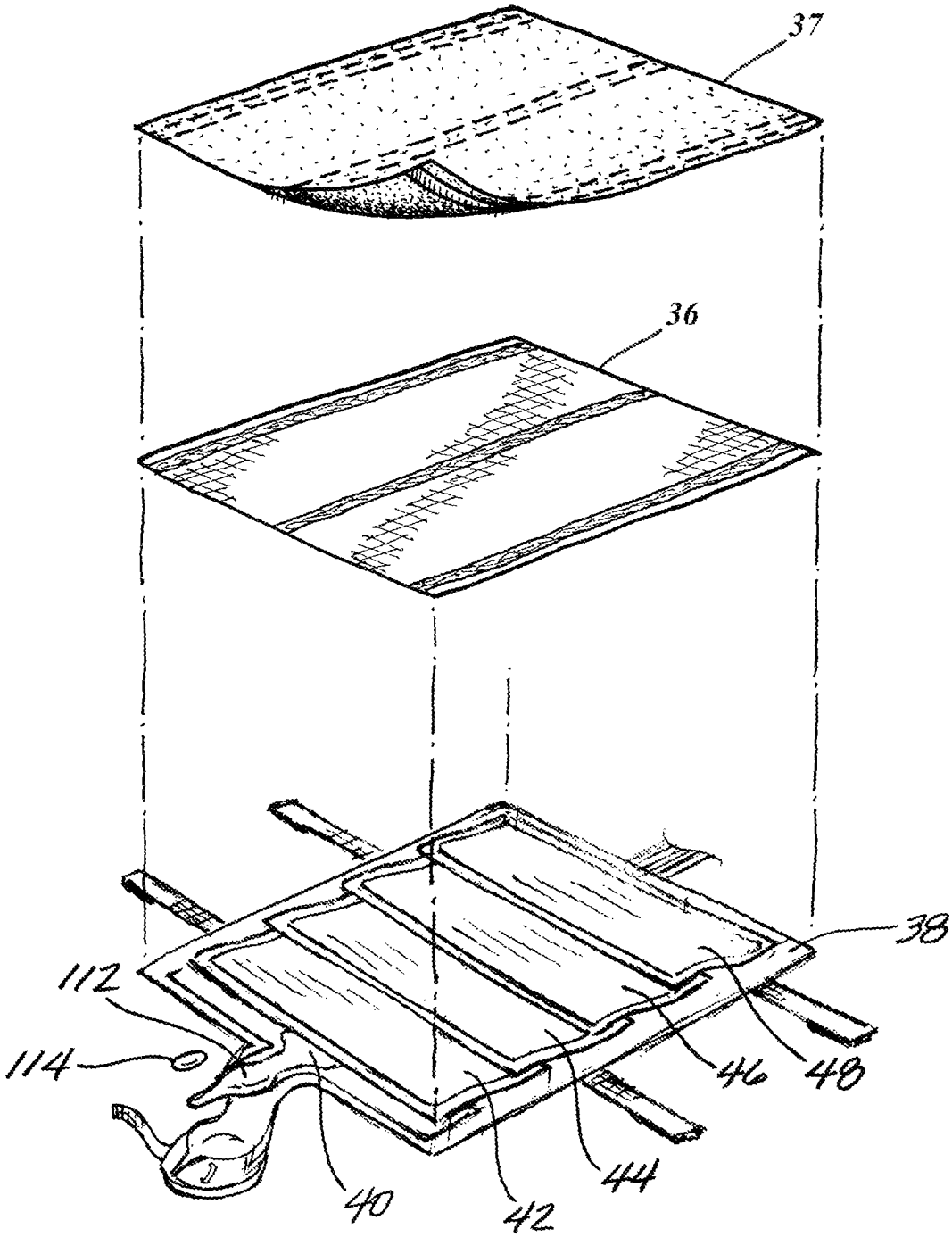
FIG. 2 is an exploded perspective view of the compression wrap member portion of this invention showing the inner cover material above the series of bladders in place upon the outer material prior to final assembly.
Figure 9:
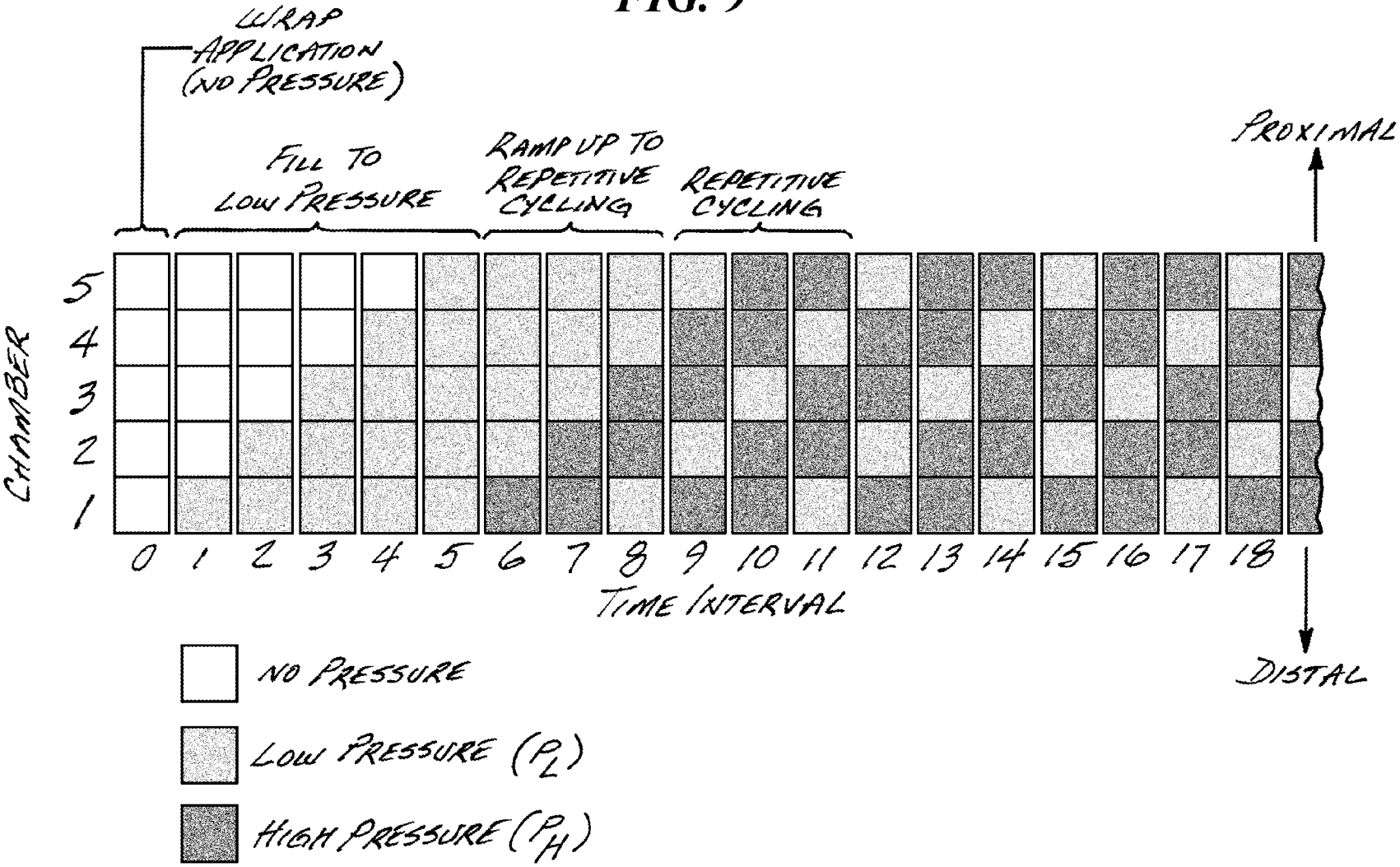
FIGS. 9 and 9A through 9J, are respective schematic views depicting the various stages of sequential pressurization of the bladder members in implementing the methodology of this invention for different numbers of chambers and pressure wave patterns.
Figure 9A:
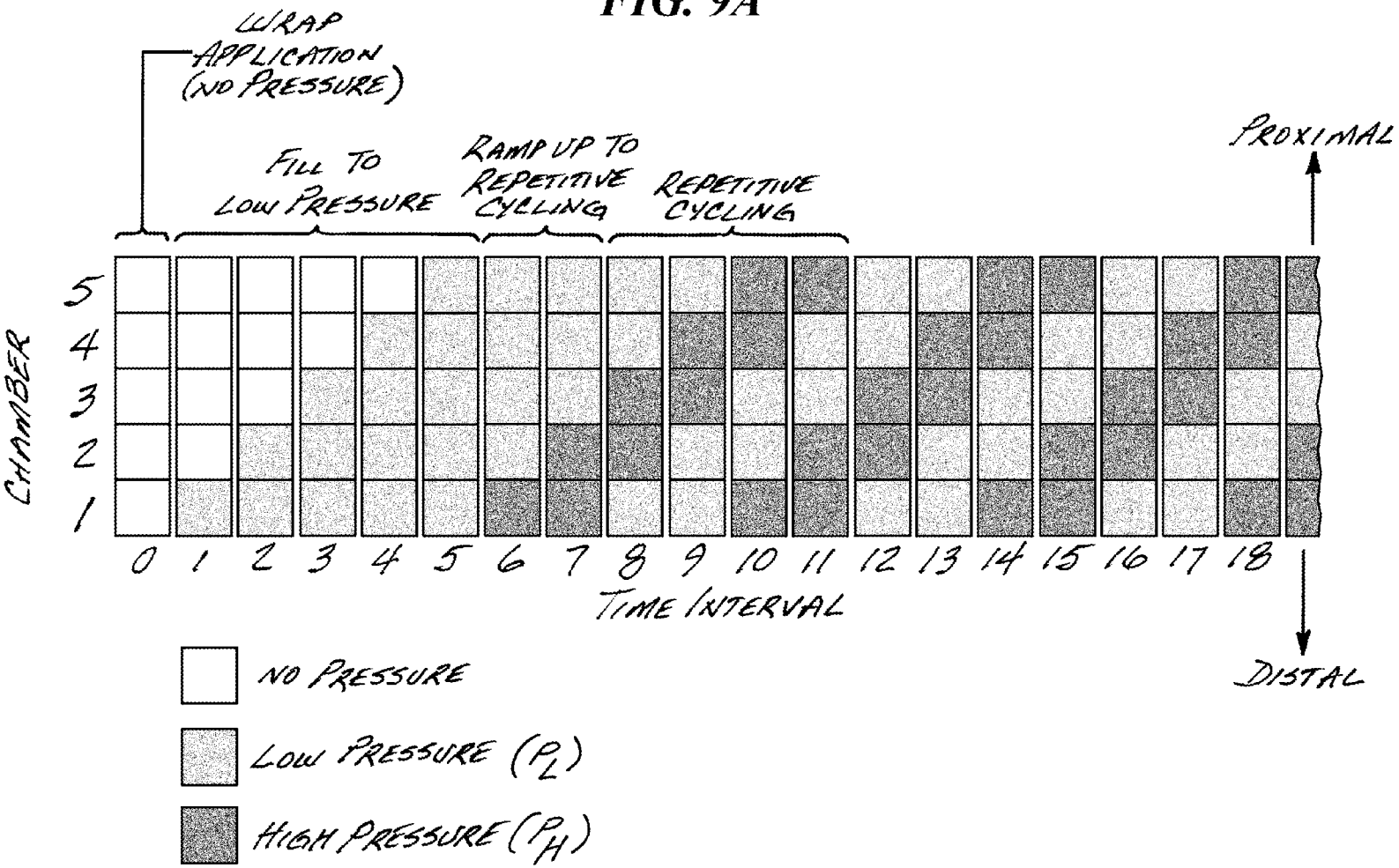
Figure 9B:
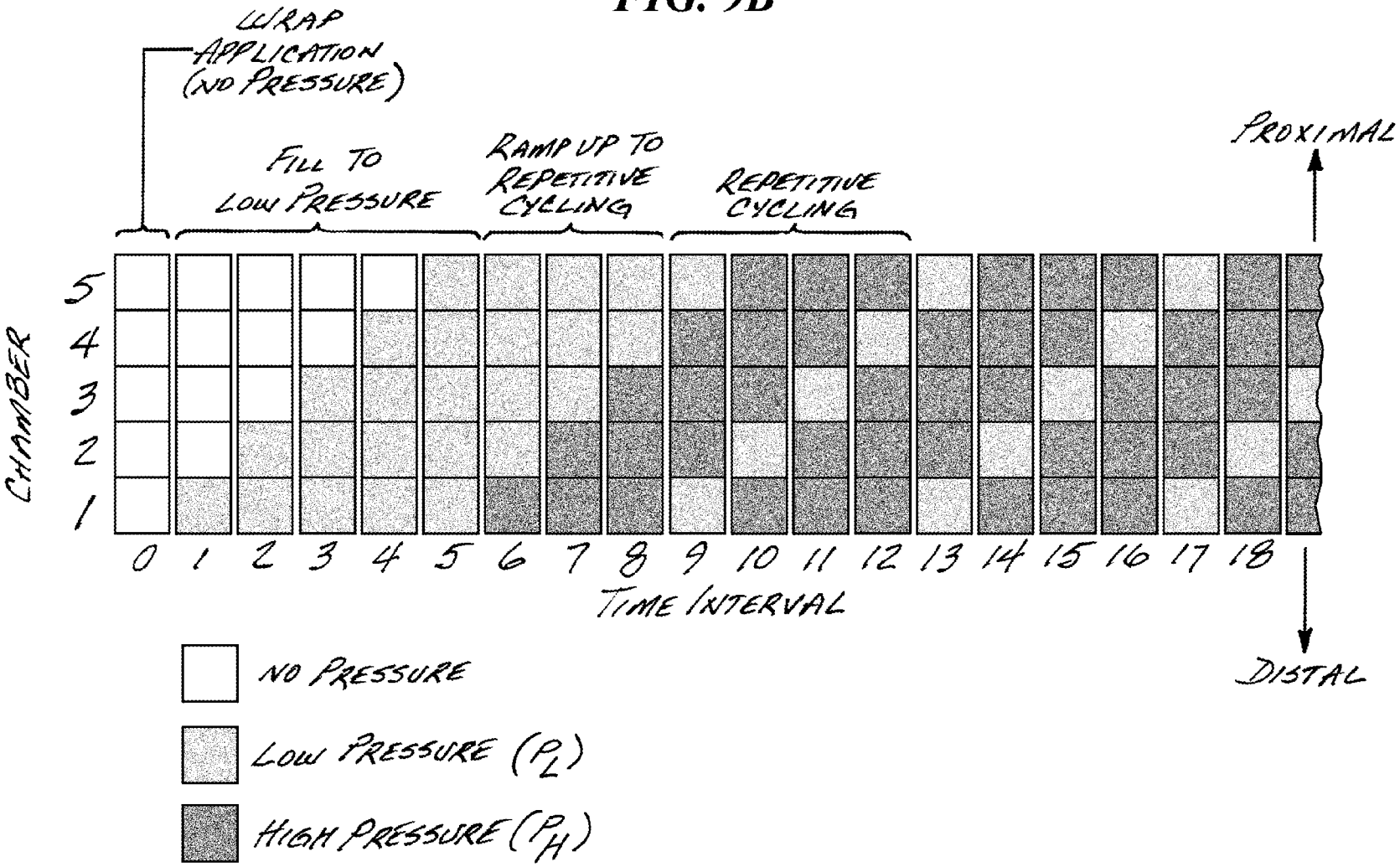
Figure 9C:
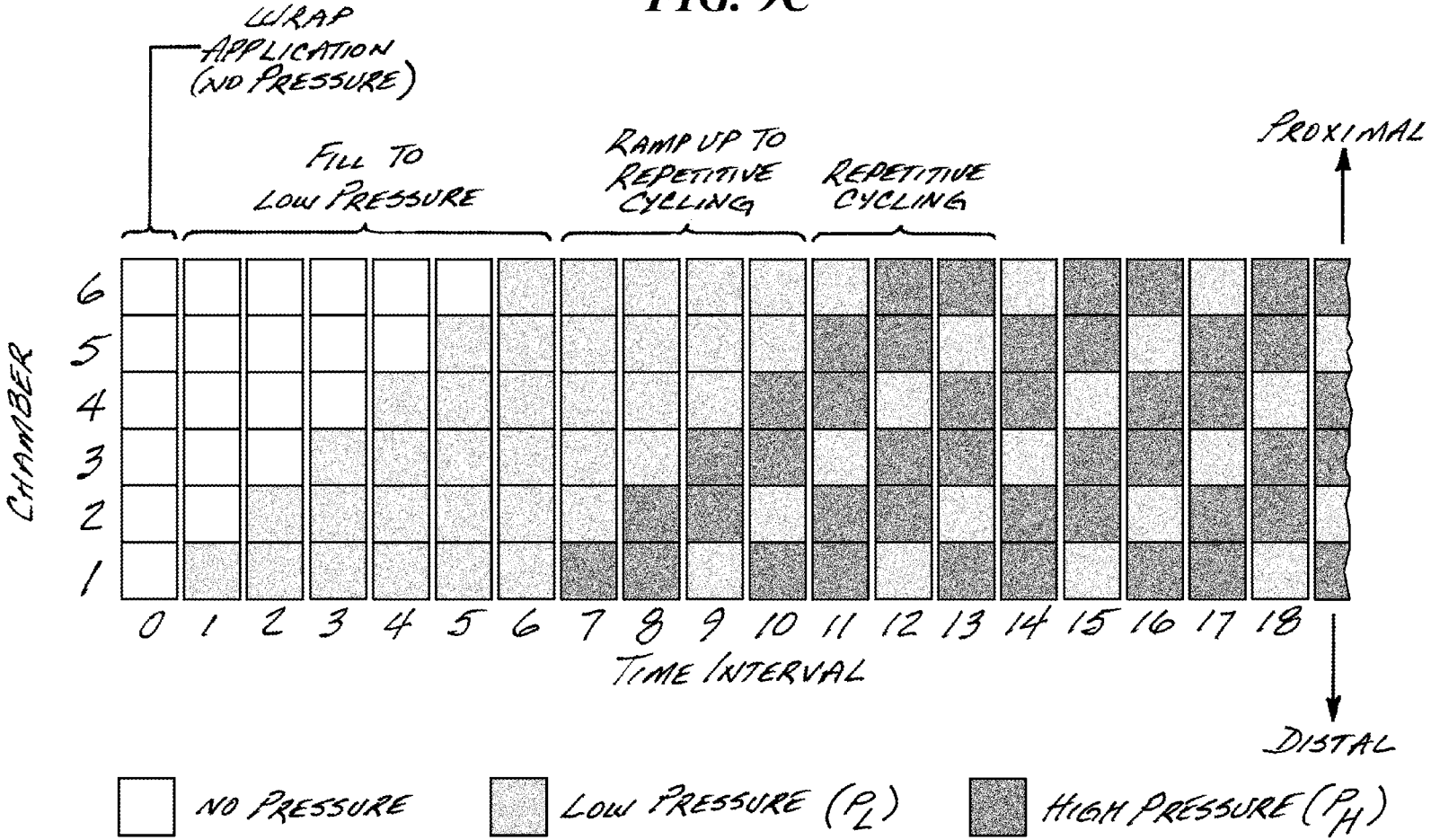
Figure 9D:
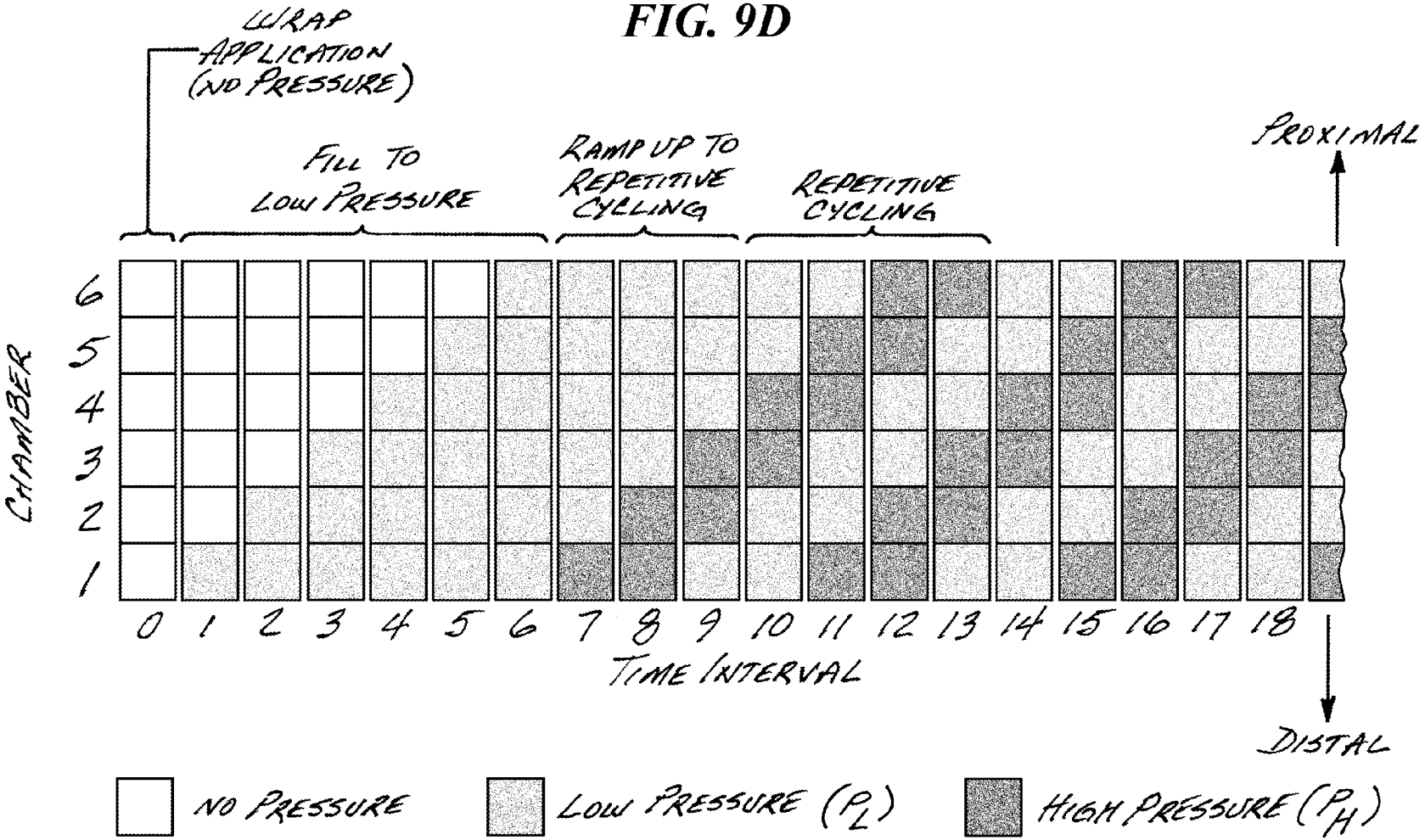
Figure 9E:
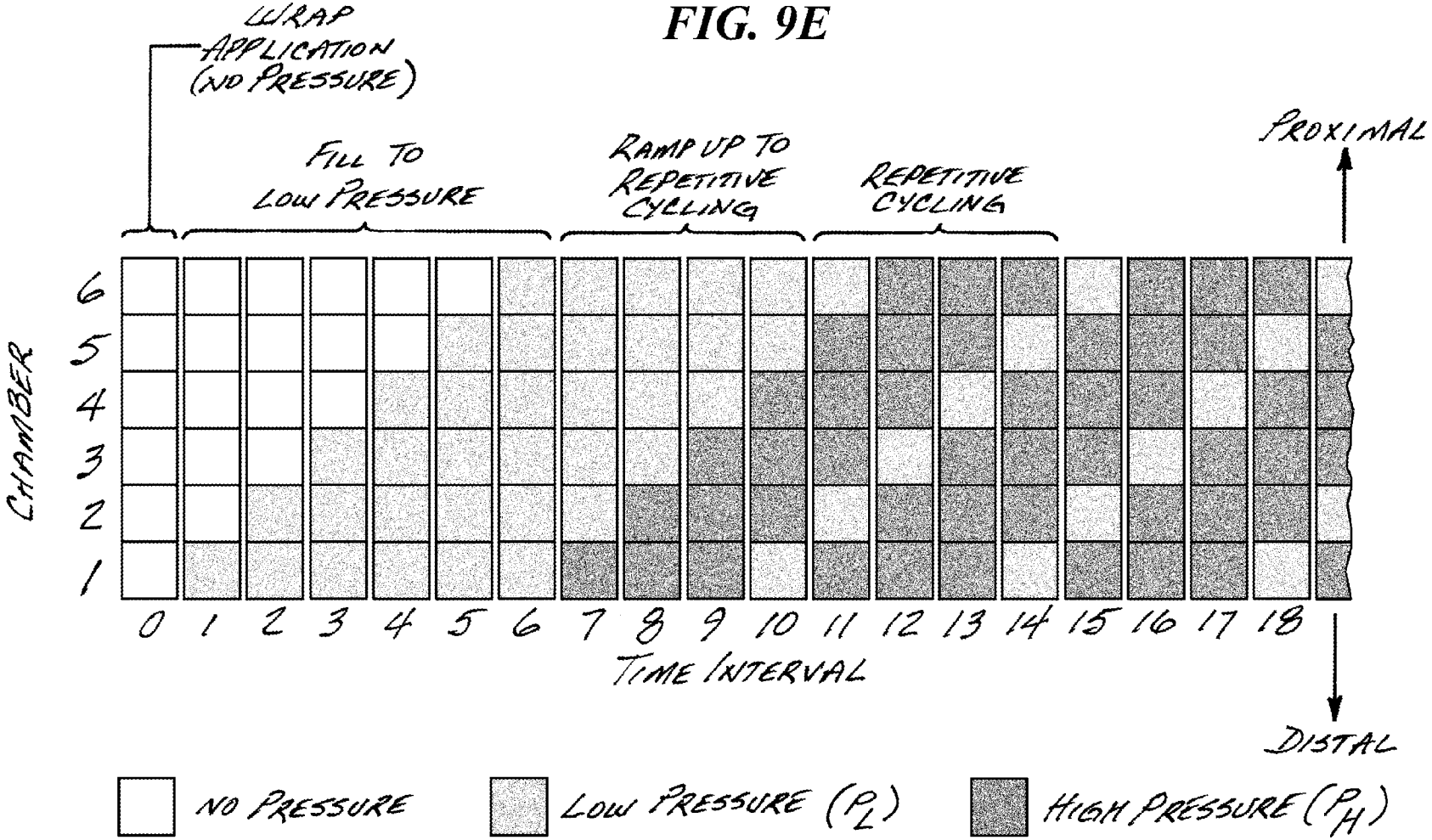
Figure 9F:
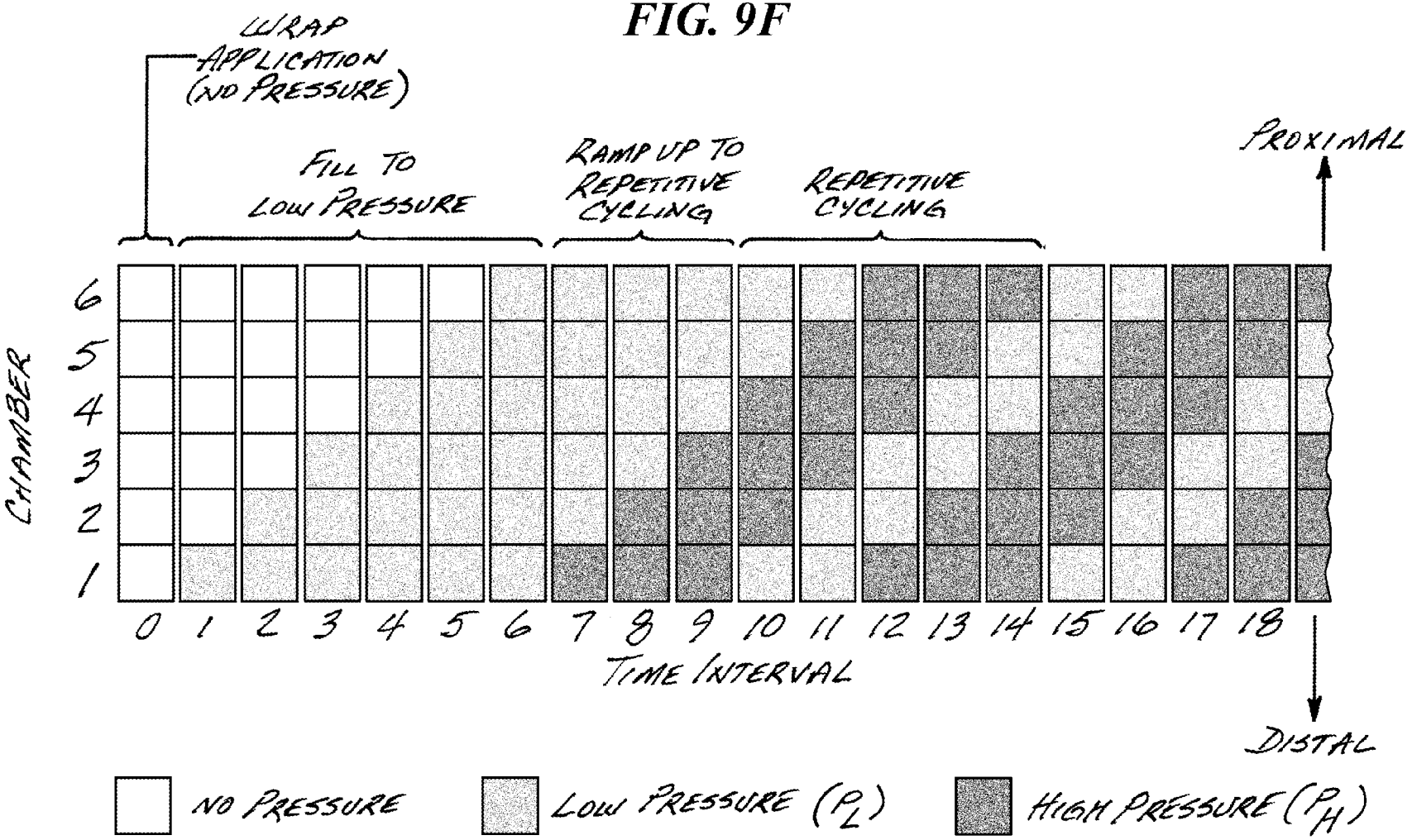
Figure 9G:
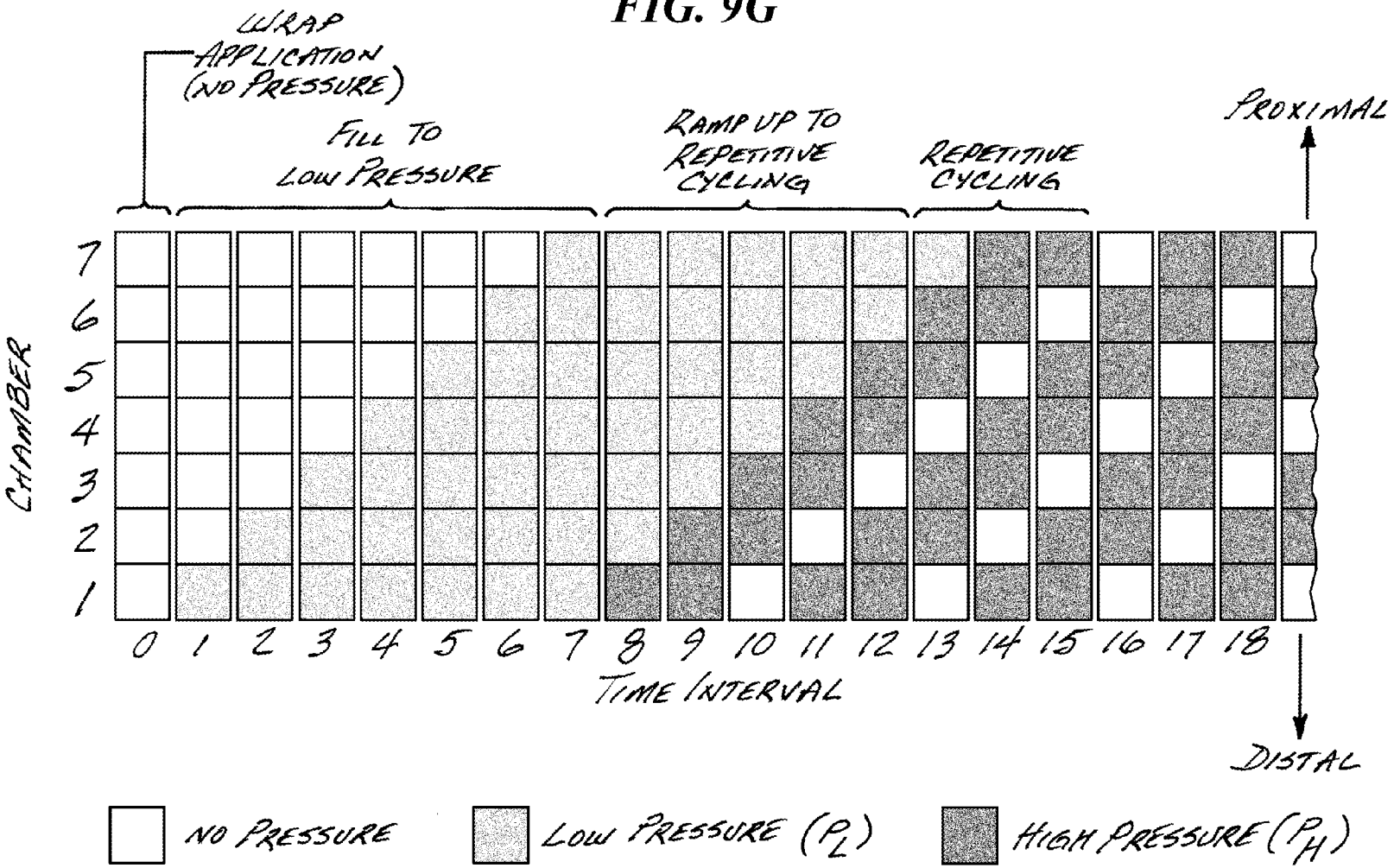
Figure 9H:
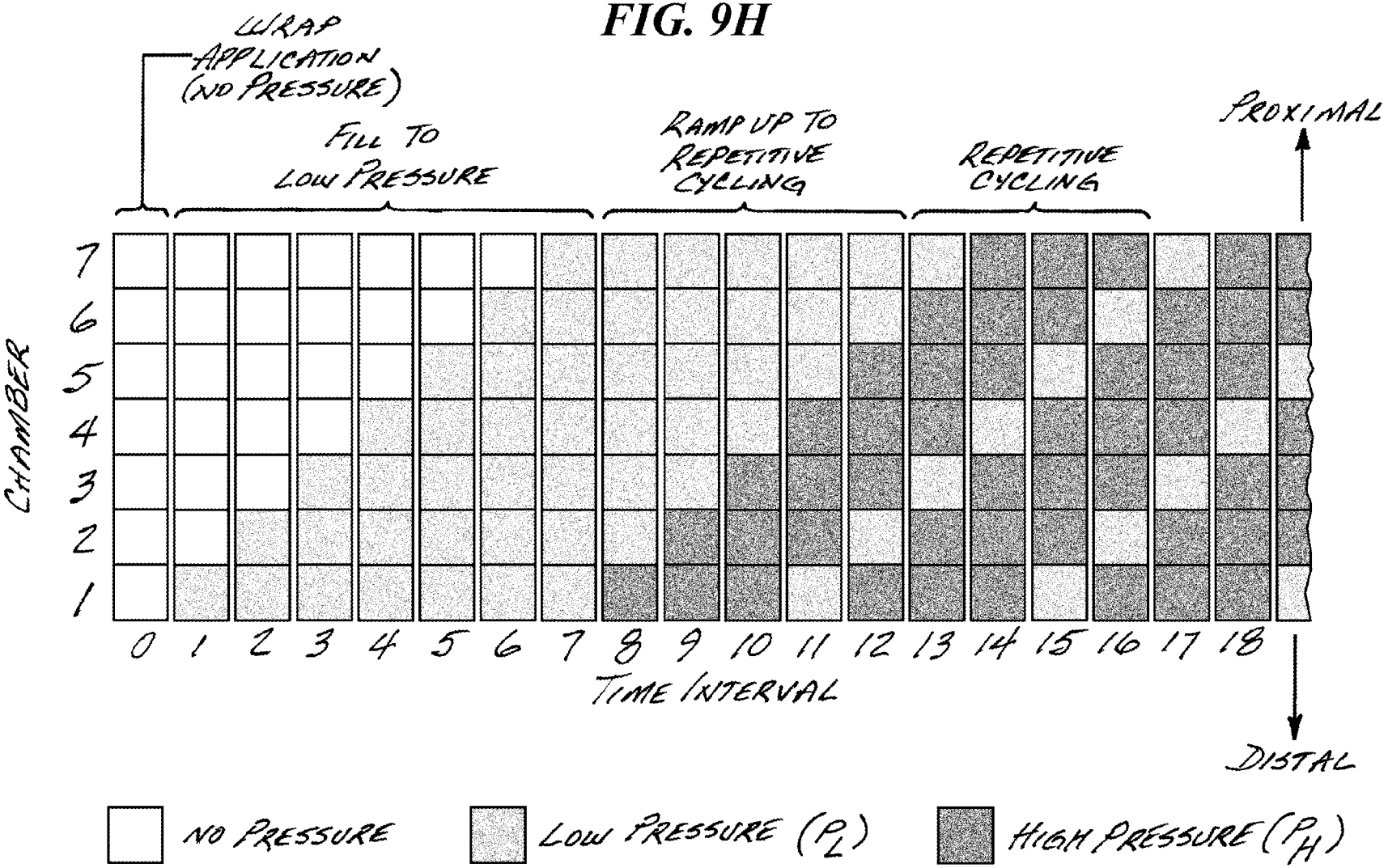
Figure 9I:
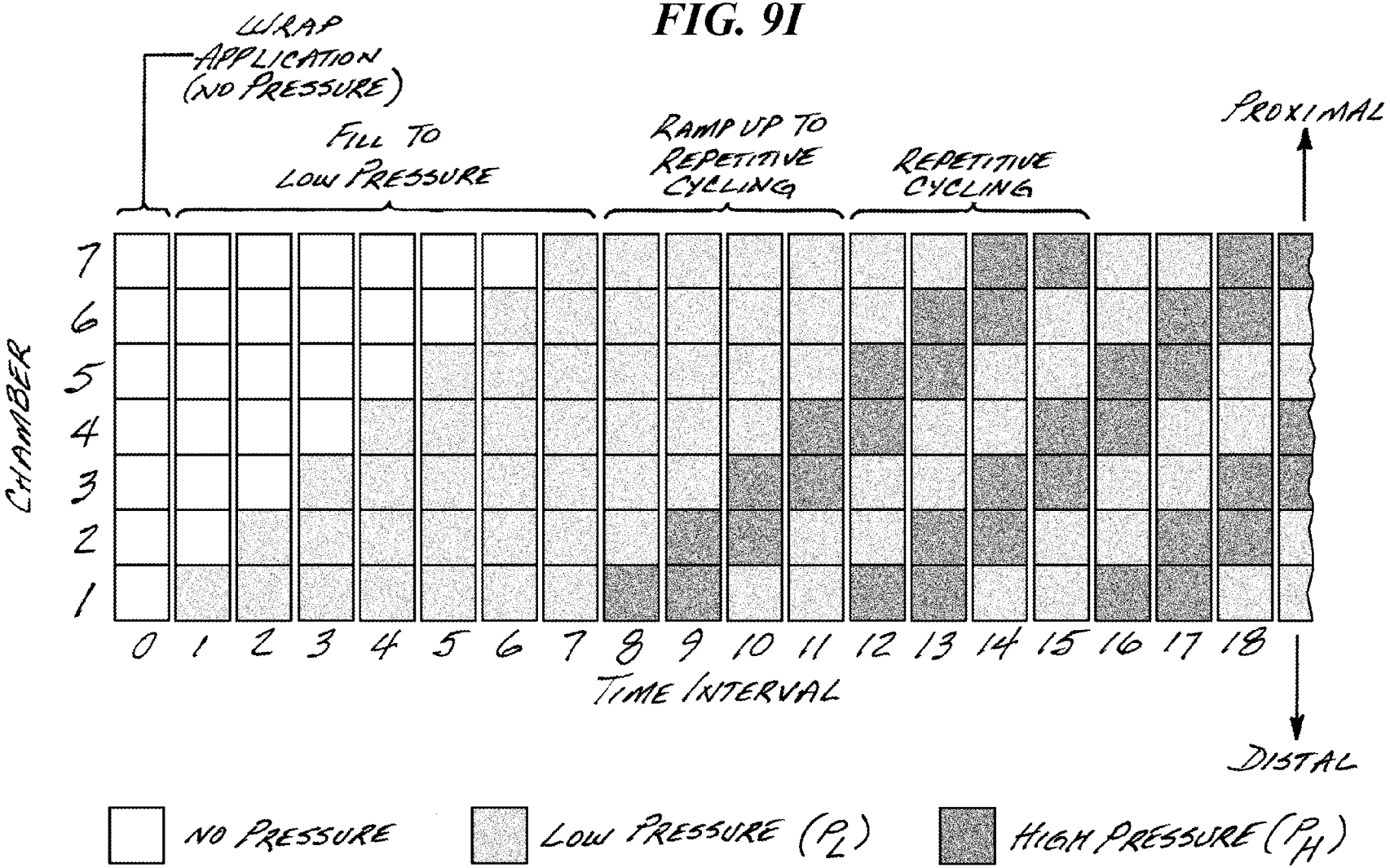

Referring to FIG. 2, the garment section is shown in an exploded view to reveal the bladder assembly. Garment section 22 includes top layer 36 and bottom layer 38. Each layer, 36 and 38, are made of heat sealable (or RF) pack cloth material (for example Gortex), available from "Seattle Fabrics" of Seattle, Wash. or similar supplier. For the embodiment shown, a series of 5 bladders, non porous 40, 42, 44, 46, and 48 are depicted, spaced along the length of layer 38. The methodology of the invention allows for as few as three bladders. However, the practicalities of the device's application, especially with equines, warrant, no less than a four bladder configuration, and typically one with five bladders as depicted in FIG. 9. A higher number of individual bladders is possible as dictated by circumstances and the limitations of manufacture. A higher number of bladders may provide a degree of redundancy in case of an unknown bladder failure during use. As shown, the bladders overlap a respective, adjacent bladder. This overlap is approximately ⅓. So, bladder 42 overlaps bladder 40; bladder 44 overlaps bladder 42; bladder 46 overlaps bladder 44; and bladder 48 overlaps bladder 46. The top-side surface of layer 36 as seen in FIG. 2, may include a method of fastening (lengthwise VELCRO brand hook and eye strips are shown) a removable and reusable lining 37 such as a soft KODEL, or similar market type, fleece or sheep skin lining (not shown). This top side surface will be immediately adjacent the horse's skin. Thus the softer lining will minimize the discomfort, absorb perspiration, and decrease friction of cycling associated with the wrap member in place.

As particularly described hereinafter, the bladders are made of heat, RF, or similar technology, sealable, Oxford nylon fabric also available from "Seattle Fabric" of Seattle, Wash. or similar supplier.

Figure 2A:
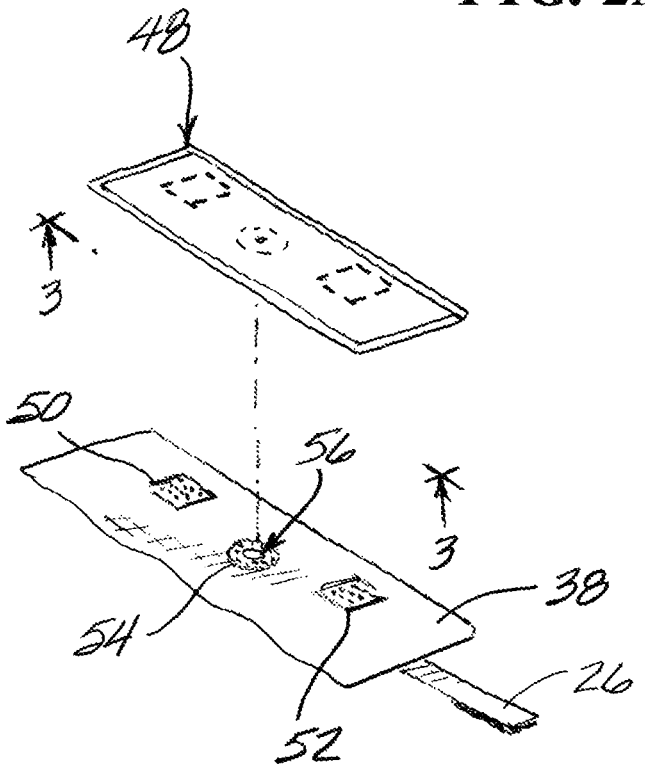
FIG. 2A is an exploded perspective view of a single bladder shown above the outer material.

FIG. 2A is a perspective view of a typical bladder, such as 48, disposed above bottom layer 38 of garment section 32.

Again, layer 38 is heat, RF, or similar technology sealable pack cloth material. Disposed hereon are VELCRO or similar supplier pads 50 and 52 (a total of 10 for a 5 bladder configuration); and a VELCRO or similar supplier disc 54 (a total of 5, again, for a 5 bladder configuration). A hole 56 is formed in both the layer 38 and VELCRO or similar supplier disc 54 to provide access for a fitting disposed on the bladder and which will be discussed hereinafter.

Figure 3:
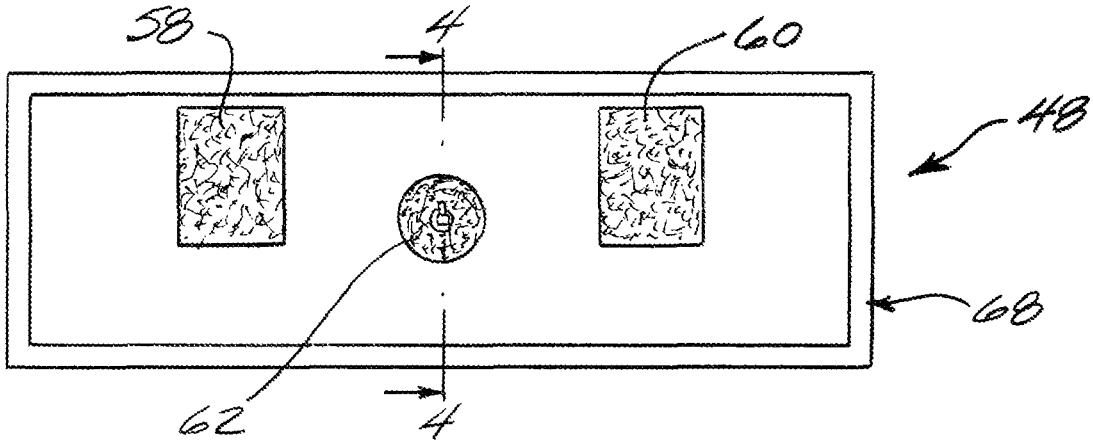
FIG. 3 is a bottom plan view of a bladder as taken along view line 3-3 of FIG. 2A.

FIG. 3 depicts the underside of a typical bladder as shown in FIG. 2A. Each bladder is seen to include corresponding VELCRO or similar supplier pads 58 and 60 and VELCRO or similar supplier disc 62. These are positioned and complement the corresponding pads disposed on layer 38 and discussed above with respect to FIG. 2A.

Figure 4:
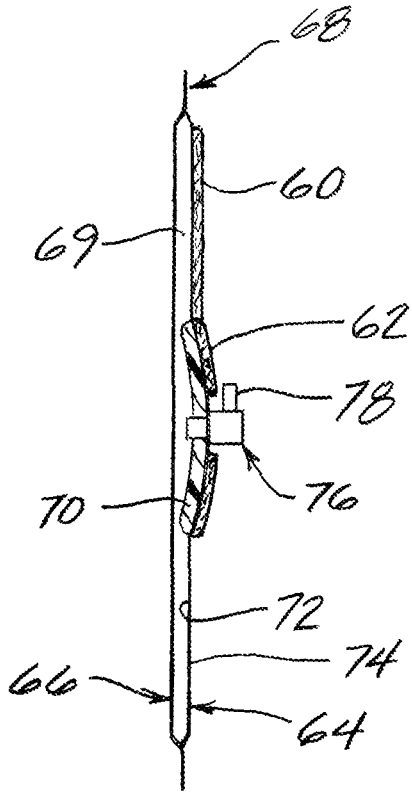
FIG. 4 is a cross-sectional view as taken along section line 4-4 of FIG. 3.

FIG. 4 shows in section, the construction of a typical bladder such as 48. Such a bladder includes layer(s) 64 and 66 which, again, is heat sealable Oxford or similar market supplier material available from "Seattle Fabrics". The layers 64 and 66 are heat sealed along perimeter edge 68 to provide a sealed volume 69 interior to the inside surfaces of layers 64 and 66.

A brass (or similarly stiff product) crescent-shaped backer plate 70 is disposed in the volume 69 and bonded to the underside surface 72 of layer 64. The complementing VELCRO or similar supplier disc 62 is likewise bonded to the outside surface 74 of layer 64. Secured to the backer plate 70 is a brass (or similarly stiff product) right angle bulkhead fitting which includes a barbed end 78. The barbed end 78 is secured to a corresponding tube of the grouping 28.

After the bladder is assembled and affixed to the VELCRO or similar supplier pads on layer 38, each bladder may be further secured to layer 38 by heat tacking at different points, along the perimeter edge 68, to the layer 38. This will prevent the bladder from twisting inside the enclosure formed by layers 36 and 38.

Figure 5:
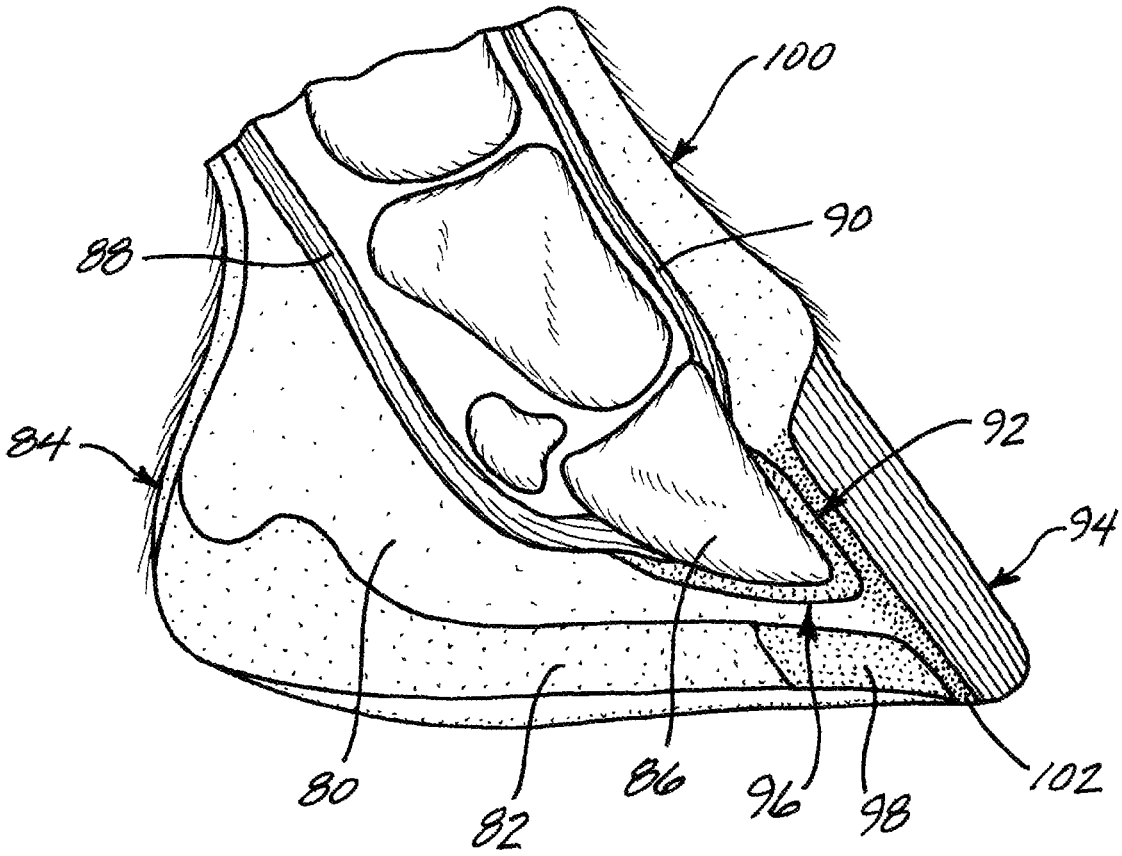
FIG. 5 is a partial transverse cross-sectional view of a horse's hoof.

Referring now to FIG. 5, shown in partial, transverse cross-sectional view is a horse's hoof. Relevant parts of the hoof for purposes of this description include the digital cushion area 80 which comprise a frog segment 82 and the bulbar area 84. The phalanx associated with the laminitis condition, the distal phalanx or P3, is identified by reference numeral 86. Secured to the under surface of the distal phalanx is the deep flexor tendon 88. Extensor tendon 90 is connected to the forward surface of P3. Covering the upper surface of the distal phalanx is an area known as the laminar corium 92. The corium consists of a dense matrix of tough, connective tissue containing blood vessels and nerves. It is responsible for the growth and maintenance of the connective tissue lamellae, between P3 and the inside surface of the hoof wall 94. What is known as sole corium 96 is disposed between the distal phalanx and the sole portion of the hoof, 98. This whole area of the horse's hoof is enclosed by wall 94 and skin 100. The so-called "white line" 102 is in fact the inner layer of the wall. It is softer and fibrous in structure and grows out of, in part, the connections between the upper surface of the distal phalanx and the inner hoof wall. Essentially laminitis is a failure of the connective tissue bond between the inner hoof wall and upper surface of the distal phalanx.

Figure 5A:
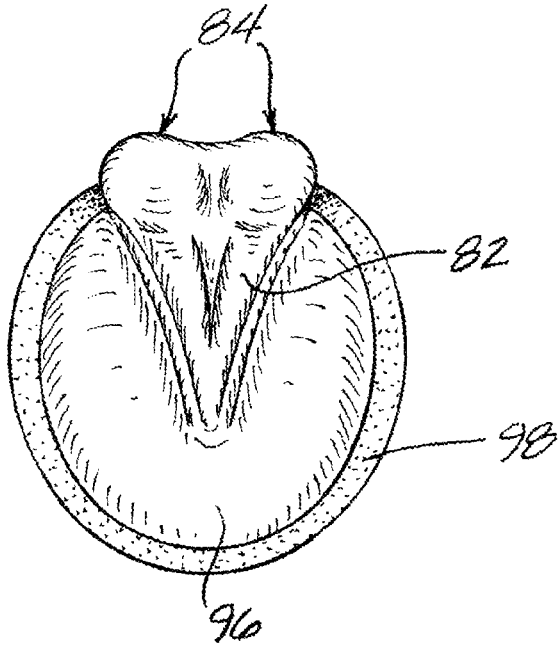
FIG. 5A is a bottom plan view of a horse hoof as taken along view line 5A-5A of FIG. 1.

The frog segment 82, as perhaps better seen in FIG. 5A, is somewhat of a heart-shaped structure that extends forward across about two-thirds of the sole. At the back it merges with the heel and the bulbar area of the digital cushion. Of importance to the present invention is the fact that the frog acts like a pump to move the blood back to the heart—a great distance from the relatively thin leg to the main organ of the circulatory system. The frog is anatomically analogous to the human finger tip. The wall is anatomically analogous to the finger or toenail of a human.

Figure 6:
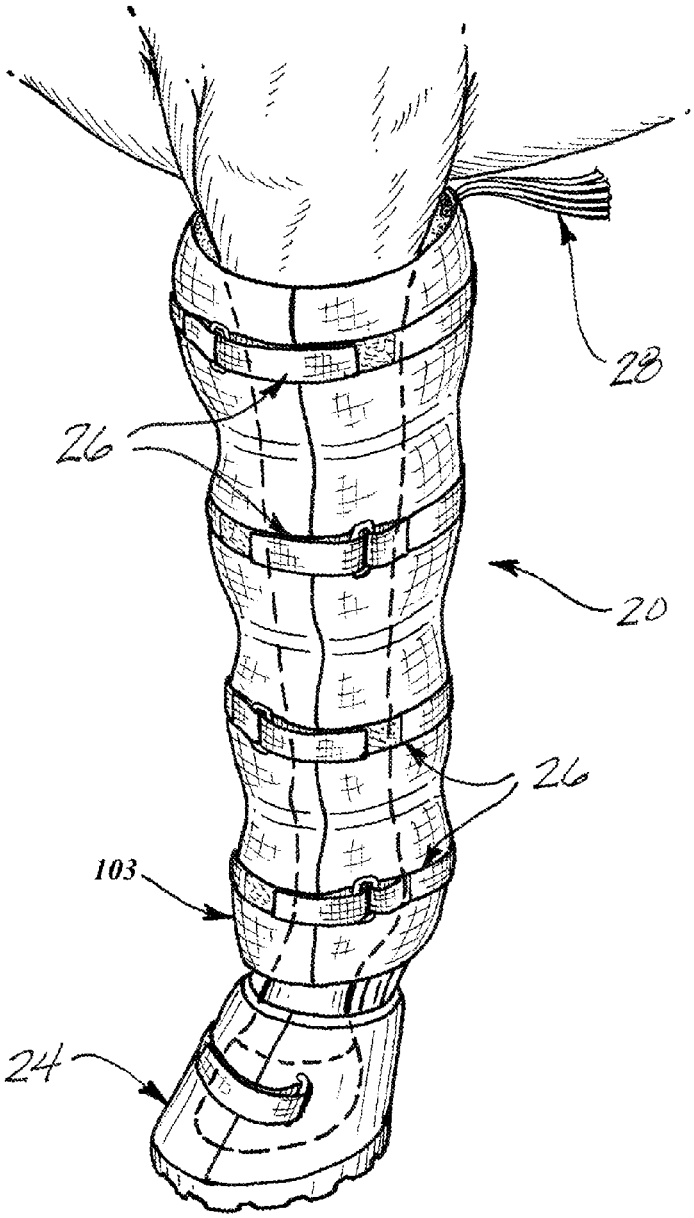
FIG. 6 is a perspective view of a front, left horse leg with the compression wrap member portion of this invention in place.
Figure 6A:
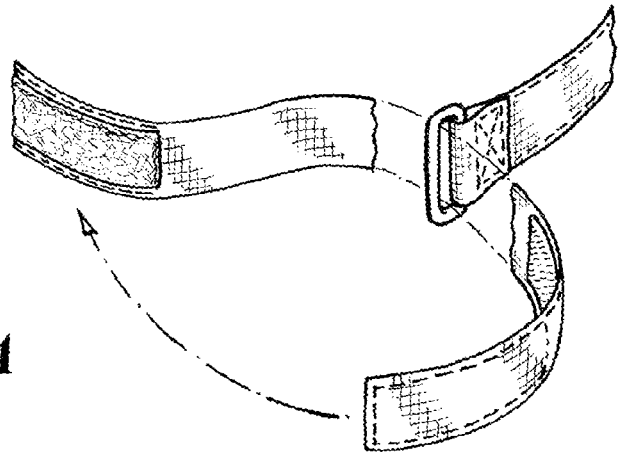
FIG. 6A is a perspective view of a strap with D-ring used to secure the wrap member to the animal's leg.

FIG. 6 shows the compression wrap member portion 20 of the invention in place on the horse's or animal's limb. The VELCRO or similar supplier straps 26 with D-rings, allow for the draw down of the wrap in an alternating way. For example, the strap on the chamber 103 immediately above the hoof, is drawn to the left as viewed in FIG. 6; while the immediately adjacent strap above is drawn to the right, and so forth up the leg. The straps 26 are generally positioned at the center of a respective chamber. The D-ring forces the VELCRO or similar supplier strap to draw upon itself when inflation occurs so as to preclude the release of the strap and thus the opening of the wrap member. (See FIG. 6A). Additionally, the use of the VELCRO or similar supplier straps, or equivalent releasably securing means allows for the almost immediate removal of the wrap member from the horse's leg. This is important in that a horse is a fidgety animal and is disturbed at the smallest upset. The ability to unravel the wrap member relatively quickly assures that the horse does not become entangled in the compression wrap member and tubing which might create the possibility of further serious injury.

Figure 6B:
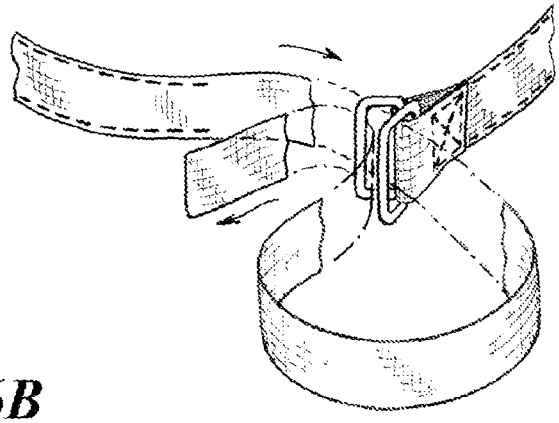
FIG. 6B is a perspective view of a strap with a double D-ring used to secure the wrap member to the animal's leg.

FIG. 6B depicts another arrangement for releasably securing the straps 26. In this drawing a double D ring is shown and the method of cinching the strap. The end of the strap can include a Velcro portion which engages a complementing portion to keep the end from flapping. This can be used instead of the single D-ring Velcro arrangement of FIG. 6A; or in addition to the FIG. 6A arrangement if a finer adjustment in tying down a particular chamber(s) is needed, especially when the therapeutic cycling is underway.

Again referring to FIG. 6, the inflatable bladders, as described above, are within the garment which is in contact and surround completely the horse's or animal's limb. Tubing 28 is dressed along the length of the wrap member and is directed in a safe manner away from the horse to the pressure source and system control means (see FIG. 10), The hoof covering segment 24 is also shown in place and its interrelationship or interaction with the hoof is better understood from viewing FIGS. 7 and 8.

The wrap member is shown secured in place by the tightening down the respective VELCRO or similar supplier straps 26. Hoof covering segment 24 is similarly secured through its VELCRO or similar supplier connection 104. The hoof covering segment or boot 24 serves multiple purposes. The delamination of the lamellae between the inner surface of the hoof wall and the digital phalanx results in the hoof starting to splay outward such that the sole becomes flatter. With the boot in place the wall integrity of the hoof is maintained and is protected against splaying while at the same time keeping the painful sole off of hard surfaces.

Figure 8:
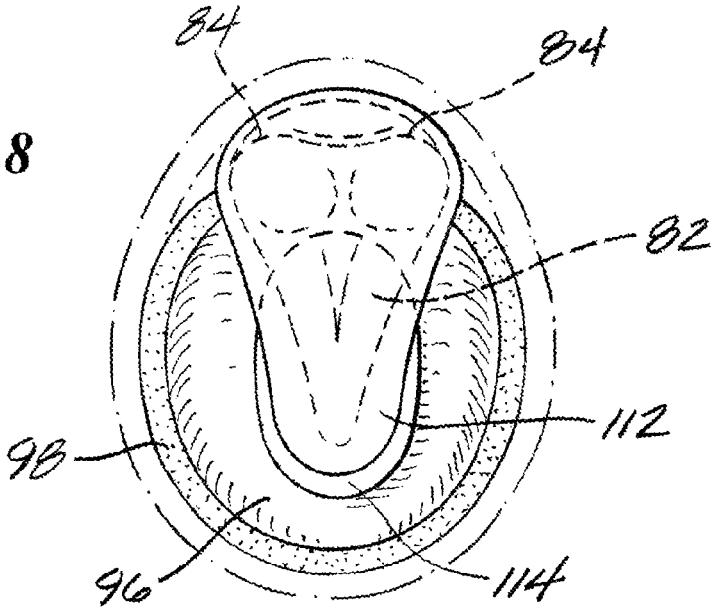
FIG. 8 is a bottom plan view similar to FIG. 5A wherein the lower bladder and silicon pad of the present invention are in place.
Figure 7:
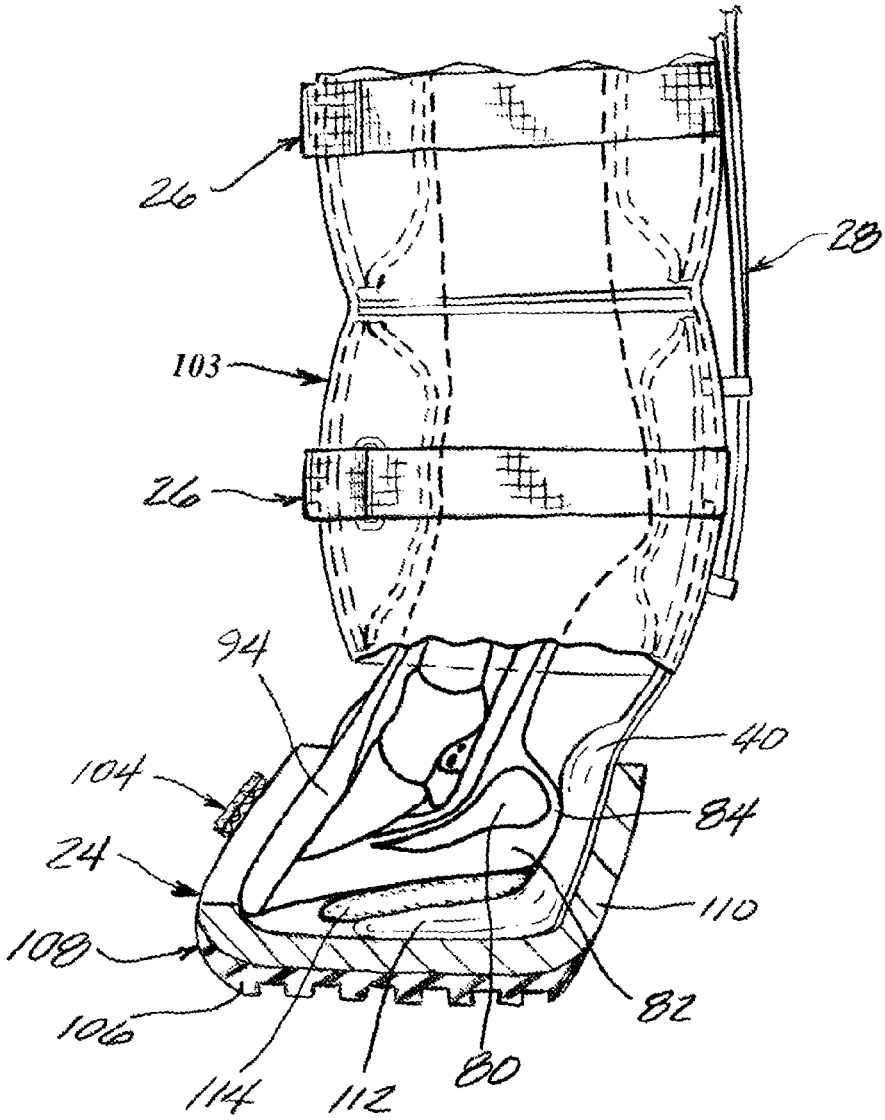
FIG. 7 is a partial, transverse cross-sectional view of the compression wrap member portion of this invention as shown in place in FIG. 6, including, principally, the segment that covers the hoof.

The boot is made in a similar manner to the shoe worn by horses known as the "Sport Boot" by CAVALLO® or similar supplier. Referring to FIGS. 7, 8, the soles of the boot 106 have a tread surface and include a rounded anterior front segment 108. The treads provide substantial traction for the animal. The sole treads can be constructed of recycled tires as a cost efficiency factor. The boot includes an upper leather portion 110 which can be lined with fleece or a sheep skin type lining; and includes a nylon cover to minimize dirt and stone abrasion.

Bladder 40 includes a tongue-shaped segment 112 (see particularly FIG. 2). When the wrap member is in use, the tongue-shaped segment 112 is disposed in the boot and is of sufficient length to cover the sole and frog areas of the horse's hoof, as well as engage the bulbar portion of the digital cushion 80. This segment stimulates the horse's circulatory system in the hoof area in accordance with the principles of the invention. As part of the inflation/deflation cycle of the present invention (see discussion for FIG. 9 below), it will assist the frog segment in pumping blood from the distal end of the limb to the proximal end.

An inner sole pad 114, made of a strong density, non-memory foam or silicone pad is interposed between the upper surface of bladder segment 112 and the frog-sole area of the animal's hoof. The pad is slightly elevated (thicker) in its central posterior area. When the bladder system is pressurized, segment 112 will urge the silicone pad upward against the resistance of the frog segment. The silicone gel will have enough give to deform laterally and, when released, enough memory to resume its normal shape. The boot with the inner sole pad 114 can remain in place on the hoof when the compression wrap member is removed.

Not clearly shown in the figures is the fact that the upper margin of the boot will have 2 or 3 "V" shaped darts lined with heavy duty elastic attached to either side of the V cut and spanning the latter. This provides a simple mechanism for keeping the boot on the hoof in addition to the VELCRO straps or similar market supplier. The edge of the boot can be rolled and or padded to minimize irritation to the coronary band and other immediately adjacent segments of the horse's hoof.

In addition to supporting the bladder segment 112 so that it can perform its principal function as the first chamber in the treatment system of the present invention, the boot portion of the invention will accomplish or assist in one or more of the following.

1. Provide the horse with an overshoe which will facilitate the protection and integrity of the hoof while providing the appropriate sole support on a soft malleable yet stable surface. This surface will facilitate the pumping action of the frog when the wrap member is not in use. The pressure and release of the shifting weight will mimic natural motion, increasing the circulation to the hoof.
2. The device will provide the appropriate ground protection and traction so that the animal, having difficulty walking because of the rotation of the coffin bone and the pain it causes with the ability to "round over", will not stumble or fall.
3. Provide an appropriate delivery system for vasodilatory medication directly to the hoof through an impregnated silicon insert pad 114 with an electrically charged delivery system—iontophoresis.
4. Provide for trans (hoof) cutaneous delivery of topical anesthesia to relieve the discomfort and minimize the side effects of long term therapy, which will be needed. This in conjunction with the electrical stimulation effect of the tens trans dermal unit will reduce pain and assist in revascularization as soon as possible. This will help to re-stabilize the scar formation to stop further rotation of bone.

The efficiency of the boot will provide horse owners with a more rapid healing process, a decrease in the recuperation and down time and most importantly, the reduction of pain for the animal and overall remission of the disease more quickly. Expanding its usefulness we can include stone bruises, thrush, vascular and foot pain in general.

With the configuration envisioned, there will be no wires circumventing the hoof. It will allow cinching the boot in place and facilitate the use of the tens trans-dermal transducer when required. This iontophoresis unit will assist with pain and provide a chance to assist in the delivery of vasodilating medication and anesthetic control to the sole of the hoof.

Figure 9J:
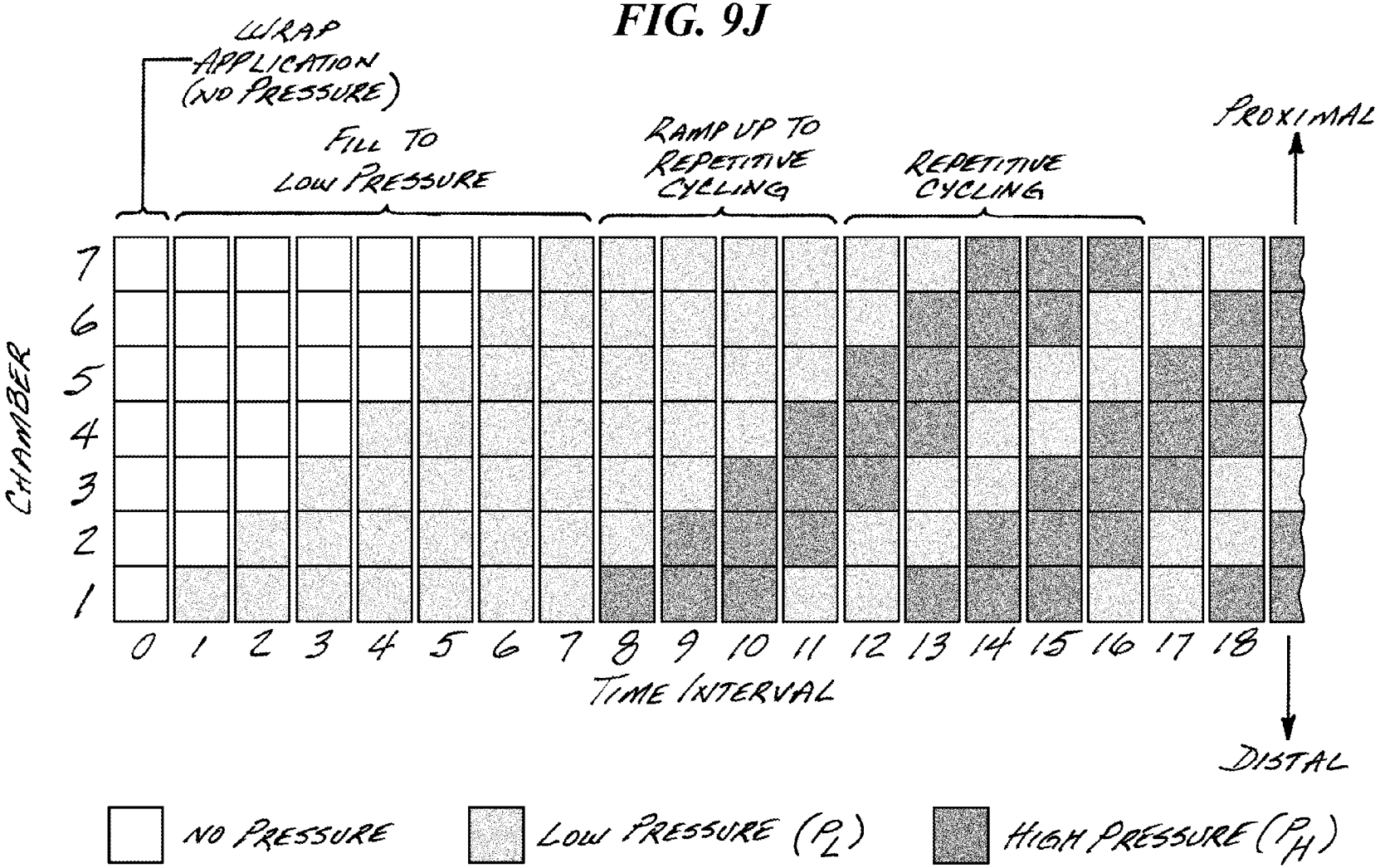
Figure 10:
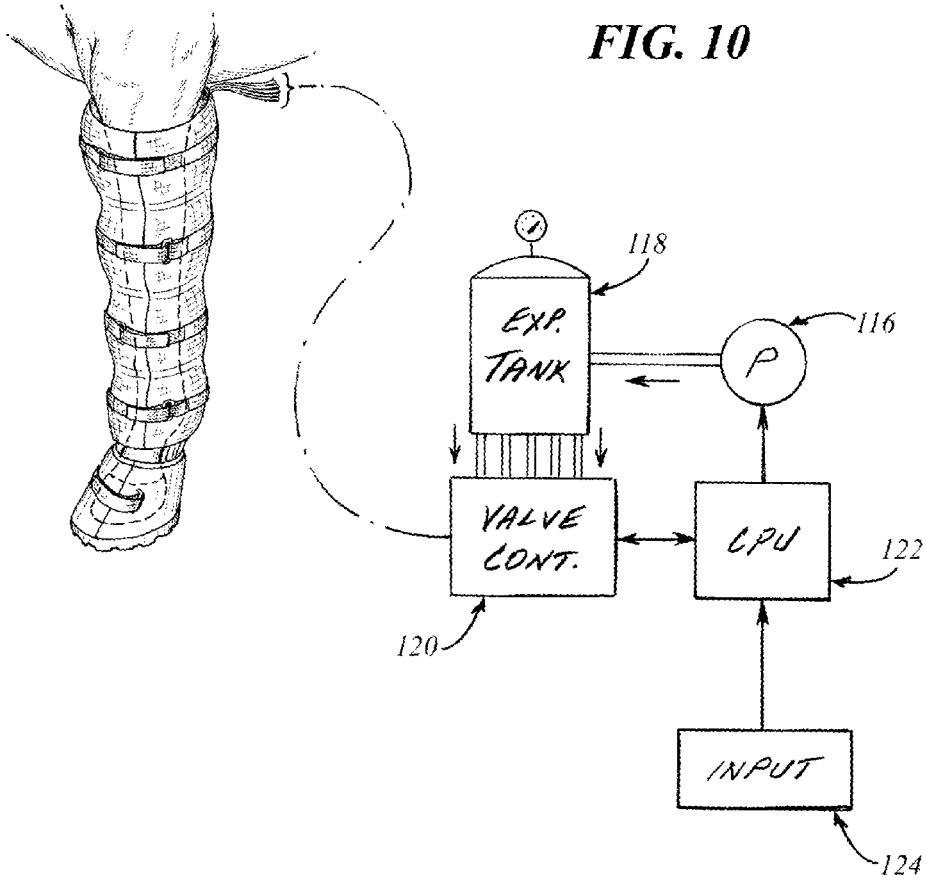
FIG. 10 is partial perspective and schematic view of the controllable pressure source portion of the invention including the connection to the bladder portion of the wrap member in place on the animal.

As suggested above, and referring to FIG. 10, a controllable pressure source includes a pump 116 connected through an appropriately sized expansion tank 118 to a known form of a valve control block 120. The expansion tank maintains a suitably stable pressure head at the input to the valve control block so that the constant pressures, $P_H$ and $P_L$ can be developed and maintained throughout the therapeutic procedure. The valve control block 120 includes a suitable valve package and pressure reducers so as to inflate, deflate and otherwise control the flow and magnitude of the pressurized fluid to and from the respective bladders positioned in the compression wrap member. A suitably programmed CPU 122 is accessed and directed, as needed, by a user through a suitable input device 124, such as a keyboard. The CPU will direct the valve control block to supply appropriate pressure levels for given time intervals, also controlled in number and length by the controllable pressure source, as may be guided by a therapy plan, such as reflected by the various FIGS. 9 through 9J.

As described, the number of bladders for purposes of this embodiment, are five; and, again, they can vary from a minimum of three to a higher number as dictated by the practicalities of the application and the needs of a particular circumstance. The higher the number, the more effective the control and overall efficacy.

For a different number of chambers, besides the repetitive cycle discussed below, the other variables that change will be the number of fill intervals which are directly related to the number of chambers, i.e. number of chambers equal the number of fill intervals; and the number of ramp-up intervals where the number of intervals will equal the number of chambers minus the number of $P_L$ in a complete wave, minus one From FIG. 9, referring to the time interval designations, it is seen that when the wrap member is first applied to the animal, of course there is no pressure in the bladders.

Initially, from the distal end to the most proximal end, each chamber is filled with a low pressure $P_L$. This is typically 0 to 15 mm Hg. Chamber number 1 is maintained at $P_L$ and the valve to chamber 2 is opened and it, too, reaches $P_L$ Each of the remaining chambers over the course of time intervals 1 through 5, are pressurized at the low pressure level, $P_L$ After all chambers, 1 through 5, have reached the low pressure status, the fill cycle is complete. The number of time intervals to reach the "fill" point, of course, is equal to the number of chambers.

After the fill cycle, the ramp-up cycle is initiated. The purpose of the ramp-up cycle is to transition the system from the "quiet" fill cycle to the dynamic, repetitive cycle. This is done so as to achieve less of a perceived change, by the animal, from the fill cycle to the dynamics that are to occur during the rigorous therapeutic or repetitive cycle phase. This ramp-up cycle, or even the fill cycle, under certain circumstances may not even be used. So, for example, after the animal has experienced the treatment over a period of days, it may be more accepting of it. This perhaps will allow the immediate application of the therapeutic, repetitive cycle phase during the therapy session.

The number of time intervals required to "ramp-up" to the repetitive, therapeutic stage are established by the number of chambers and the characteristics of the pressure wave that is to be established for the repetitive cycle (a "pressure wave" is defined as a single combination or set of adjacent $P_H$ pressurized chambers, taken as a single unit for this determination, and the number of adjacent $P_L$ inflated chambers, counted individually, again when used to determine the length of the ramp-up cycle). The number of time intervals to achieve the ramp-up cycle is the sum of the number of chambers at $P_L$ in the wave pattern, plus 1 (for the $P_H$ set) subtracted from the total number of chambers for a given wrap garment.

From the discussion below, and a consideration of the repetitive cycle of FIG. 9, it is seen that the pressure wave in FIG. 9 for a five chamber device, comprises two adjacent chambers pressurized at $P_H$ (counts as one) and one chamber pressurized at $P_L$. According to the above this results in a ramp-up cycle of three (five minus (one plus one)) time intervals before the system enters the repetitive cycle phase. At the beginning of this ramp-up cycle (for FIG. 9), pressure to chamber 1 is now increased to a higher, therapeutic pressure $P_H$. $P_H$ is in the range of 0 to 200 mm Hg, and within a preferred range of 10 to 60 mm Hg, but always in excess of $P_L$. Chambers 2 through 5 remain at the low pressure status.

In time interval number 7, chamber number 2 is now inflated with the higher pressure. In addition, and this is one of the more significant features of the present invention, chamber 1 is maintained at the higher pressure so as to eliminate back flow possibilities from the physical area of the horse's leg engaged by bladder number 2 into the area covered by bladder number 1, the hoof area. In time interval number 8, the controlled pressure source continues to direct the pressurization of chamber number 2 at $P_H$, and, although not readily apparent from the drawings, retains pressurization of chamber number 1 at PH until pressurization of number 3 is achieved, whereupon pressurization of chamber number 1 is reduced to $P_L$. The system as adapted does not permit back flow from a higher number chamber to a lower numbered one, i.e a more distal one. Thus the results achieved by the apparatus and method of the present invention are significantly advantageous.

After the compressive wrap member is pressurized through the ramp-up cycle, the repetitive cycling configuration is achieved. This occurs at interval number 9 for the embodiment represented by FIG. 9. It continues in a 5 chamber device for two further time intervals, ten and eleven. Thereafter, the system successively repeats the sequence of time intervals 9, 10 and 11.

If it desirable to return the wrap member to a complete rest cycle, the programmed controller 120 will return the wrap member, and particularly the bladders, to the interval and pressure just prior to the ramp-up cycle. In the embodiment illustrated in FIG. 9, this would be time interval number 5, where all the chambers are in their low pressure status, $P_L$ (of course, if the wrap member is to be removed, the valve control block 120 can be directed to release all pressurized fluid to the respective chambers). When it is desired to then reinstitute the pressured cycle, the controller would direct the restart of the ramp-up cycle, in a manner similar to what occurs at time interval number 6.

The pressure levels and length of time intervals (5 sec to 30 sec preferred for the therapeutic, repetitive range) are largely a variable based in part on the condition of the animal. The approach described allows the animal to get acclimated to the device by gradually increasing pressure and/or adjusting the time interval, dependent on condition. All are programmable in the controller by the CPU as inputted to by a user. It is known how to vary these pressure levels and time intervals in related technology so as to effect the ramp up and repetitive cycles as depicted in FIG. 9.

It is envisioned alternate pressurization schemes will accomplish the purposes of the invention, with the underlying criteria that venous back flow from a proximal to a more distal chamber not occur, while still permitting arterial inflow to continue.

While various preferred embodiments of the invention have been depicted in the drawings and described herein, it will be appreciated that the present invention is not limited to those precise embodiments, and that various changed and modifications can be effected therein by one ordinary skill in the art without departing from the scope or spirit of the invention as described in the following claims.

What is claimed is:

1. A method of treatment of a laminitis condition, or other condition derived from poor circulation in the leg of an animal having a hoofed area, such as a horse, comprising the steps of:

(a) provisioning a wrap member, having a predetermined length said wrap member having a plurality of inflatable chambers, including a most distal one and a most proximal one, positioned at respective intervals along the length of the wrap member, said most distal one of said plurality of inflatable chambers adapted to engage a compressible portion of the leg of the animal exposed within the hoofed area including the frog segment or bulbar area, said wrap member further including means for releasably securing the wrap member to the leg of the animal;

(b) provisioning a controllable pressure source to each of said inflatable chambers;

(c) manipulating said wrap member including said means for releasably securing the wrap member, to position and secure said wrap member about the leg of the animal, said most distal one of said chambers engaging the compressible portion of the leg of the animal exposed within the hoofed area, the most proximal one of said chambers engaging a higher portion of the leg of the animal in an area predetermined by the length of the wrap member;

(d) activating the controllable pressure source, said controllable pressure source adapted to provide a plurality of repetitive cycles, each one of said repetitive cycles comprising a first predetermined number of successive time intervals, said controllable pressure source further adapted to provide during each time interval of said one of said repetitive cycles, either a predetermined pressure of a higher magnitude, $P_H$, or of a lower magnitude, $P_L$, to a respective one of said plurality of inflatable chambers in accordance with a predetermined wave pattern, wherein the predetermined wave pattern requires that during each time interval of said one of said repetitive cycles, at least two immediately adjacent inflatable chambers are at $P_H$ pressure and at least one of said inflatable chambers is at $P_L$ pressure, said at least two immediately adjacent inflatable chambers at $P_H$ pressure over the time of each said repetitive cycle, progressing from said most distal one and the next most distal one to the most proximal one and the next most proximal one.

2. The method of treatment claimed in claim 1 wherein said controllable pressure source is adapted to provide at least one ramp-up cycle extending over a second number of successive time intervals prior to the beginning of said repetitive cycles, said ramp-up cycle comprising a varying combination of said inflatable chambers inflated at $P_H$ and $P_L$ in accordance with a predetermined sequence based on said predetermined wave pattern.

3. The method of treatment claimed in claim 2 wherein said controllable pressure source is adapted to provide at least one fill cycle prior to providing said at least one ramp-up cycle, each of said inflatable chambers filled at a pressure less than $P_H$ during said fill cycle.

4. The method of treatment claimed in claim 1 wherein said controllable pressure source is adapted to provide at least one fill cycle prior to the beginning of said repetitive cycles, each of said inflatable chambers filled at a pressure less than $P_H$ during said fill cycle.

5. The method of treatment claimed in claim 4 wherein each of said inflatable chambers is filled at $P_L$ during said fill cycle.

6. The method of treatment claimed in claim 1 wherein said most distal one of said plurality of inflatable chambers is disposed within a boot releasably secured to the hoof of the animal, said boot adapted to facilitate the engagement of said most distal one of said inflatable chambers with the compressible portion of the leg of the animal.

7. The method of treatment claimed in claim 6 wherein there is also included and being disposed between an upper surface of said most distal one and the compressible portion of the leg of the animal exposed within the hoofed area, an inner sole pad.

8. The method of treatment claimed in claim 7, wherein said inner sole pad is adaptable to be impregnated with a variety of medications including vasodilatory and topical anesthesia medications.

9. The method of treatment claimed in claim 7 wherein said inner sole pad is adaptable to be a facilitator with an electronically charged medicament delivery system.

10. The method of treatment claimed in claim 7 wherein after the performance of the treatment, said controllable pressure source is deactivated and said wrap member is removed from the leg of the animal, however said boot and said inner sole pad remain in place on the hoof of the animal, said inner sole pad now disposed between an inner sole surface of the boot and the compressible portion of the leg of the animal exposed within the hoof area.

11. The method of treatment claimed in claim 10, wherein said inner sole pad is adaptable to be impregnated with a variety of medications including vasodilatory and topical anesthesia medications.

12. The method of treatment claimed in claim 10 wherein said inner sole pad is adaptable to be a facilitator with an electronically charged medicament delivery system.

13. The method of treatment claimed in claim 1 wherein said controllable pressure source includes a valve control box and respective tubing to connect between said valve control box and respective ones of said inflatable chambers, said tubing having a predetermined inside diameter, said controllable pressure source in cooperation with said tubing adapted to permit an emergency deflation of the pressurized inflatable chambers in less than fifteen seconds.

14. A system used in the treatment of a laminitis condition, or other condition derived from poor circulation and affecting the leg of an animal having a hoofed area, such as a horse, the system comprising:

(a) a wrap member, having a predetermined length said wrap member having a plurality of individually inflatable chambers, including a most distal one and a most proximal one, positioned at respective intervals along the length of the wrap member, said most distal one of said plurality of inflatable chambers adapted and configured to engage a compressible portion of the leg of the animal exposed within the hoofed area including the frog segment or bulbar area, said wrap member further including means for releasably securing the wrap member to the leg of the animal; and, (b) a controllable pressure source, said controllable pressure source adapted to provide a plurality of repetitive cycles, each one of said repetitive cycles comprising a first predetermined number of successive time intervals, said controllable pressure source further adapted to provide during each time interval of said one of said repetitive cycles, either a predetermined pressure of a higher magnitude, $P_H$, or of a lower magnitude, $P_L$, to a respective one of said plurality of inflatable chambers in accordance with a predetermined wave pattern, wherein the predetermined wave pattern requires that during each time interval of said one of said repetitive cycles, at least two immediately adjacent inflatable chambers are at $P_H$ pressure and at least one of said inflatable chambers is at $P_L$ pressure, said at least two immediately adjacent inflatable chambers at $P_H$ pressure over the time of each said repetitive cycle, progressing from said most distal one and the next most distal one to the most proximal one and the next most proximal one.

15. The system claimed in claim 14 wherein said wrap member has a lengthwise or longitudinal axis and a horizontal axis perpendicular to said longitudinal axis, said most distal one of said inflatable chambers extending in a direction substantially parallel to said longitudinal axs, said remaining ones of said plurality of individually inflatable chambers extending substantially parallel to said horizontal axis, said most distal one extending in a manner when disposed beneath the under surface of the hoofed area such that it contacts at least the bulbar area and frog segment of the digital cushion of the animal, when the animal is a horse.

16. The system claimed in claim 15 further comprising a boot adapted to be releasably secured to the hoof of the animal, said boot further adapted to facilitate the engagement of said most distal one of said inflatable chambers with the compressible portion of the leg of the animal.

17. The system claimed in claim 16 wherein there is also included an inner sole pad, said inner sole pad adapted to be disposed between an upper surface of said most distal one and the compressible portion of the leg of the animal exposed within the hoofed area.

18. The system claimed in claim 17, wherein said inner sole pad is adaptable to be impregnated with a variety of medications including vasodilatory and topical anesthesia medications.

19. The system claimed in claim 17 wherein said inner sole pad is adaptable to be a facilitator with an electronically charged medicament delivery system.

* * * * *